US007573356B2

(12) United States Patent
Kawai et al.

(10) Patent No.: US 7,573,356 B2
(45) Date of Patent: Aug. 11, 2009

(54) TUNABLE FILTER

(75) Inventors: Kunihiro Kawai, Yokohama (JP); Hiroshi Okazaki, Yokosuka (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 19 days.

(21) Appl. No.: 11/677,878

(22) Filed: Feb. 22, 2007

(65) Prior Publication Data

US 2007/0200651 A1 Aug. 30, 2007

(30) Foreign Application Priority Data

Feb. 28, 2006 (JP) ..... 2006-053853

(51) Int. Cl.
*H01P 3/08* (2006.01)

(52) U.S. Cl. ..... 333/205; 333/225; 333/235

(58) Field of Classification Search ..... 333/202, 333/204–205, 207, 219, 223, 225, 235
See application file for complete search history.

(56) References Cited

U.S. PATENT DOCUMENTS

| | | | | |
|---|---|---|---|---|
| 5,162,759 | A | 11/1992 | Yajima | |
| 6,043,727 | A | 3/2000 | Warneke et al. | |
| 6,452,465 | B1 * | 9/2002 | Brown et al. | 333/205 |
| 7,292,124 | B2 * | 11/2007 | Kawai et al. | 333/219 |
| 2003/0025563 | A1 | 2/2003 | Christensen | |
| 2004/0036558 | A1 * | 2/2004 | Allison et al. | 333/205 |
| 2005/0190018 | A1 | 9/2005 | Kawai et al. | |
| 2006/0087388 | A1 | 4/2006 | Kawai et al. | |

FOREIGN PATENT DOCUMENTS

| | | |
|---|---|---|
| EP | 0 849 820 A2 | 6/1998 |
| EP | 1 562 253 A1 | 8/2005 |
| JP | 2001-230602 | 8/2001 |
| JP | 2002-9573 | 1/2002 |
| JP | 2004-7352 | 1/2004 |

(Continued)

OTHER PUBLICATIONS

Dimitrios Peroulis, et al., "Tunable Lumped Components with Applications to Reconfigurable MEMS Filters", TU4C-6, 2001 IEEE MTT-S Digest, 2001, pp. 341-344.

(Continued)

*Primary Examiner*—Vibol Tan
*Assistant Examiner*—Jason Crawford
(74) *Attorney, Agent, or Firm*—Oblon, Spivak, McClelland, Maier & Neustadt, P.C.

(57) ABSTRACT

A tunable filter wherein coupling sections ($\mathbf{5}_1$, $\mathbf{5}_2$, $\mathbf{5}_3$) are formed in an input/output line along its lengthwise direction, each coupling section including a gap ($G\mathbf{5}_1$, $G\mathbf{5}_2$, $G\mathbf{5}_3$) formed in the input/output line and coupling electrodes ($E\mathbf{5}a_1$, $E\mathbf{5}b_1$, $E\mathbf{5}c_1$) arranged in the gap in the longitudinal direction of the input/output line; and resonators ($\mathbf{4}_1$, $\mathbf{4}_2$) capable of varying the resonance frequency are connected to the input/output line at the positions between adjacent ones of the coupling sections. Switch means ($\mathbf{7}_1$, $\mathbf{7}_2$, $\mathbf{7}_3$) are provided for selectively grounding the coupling electrodes of the coupling sections or selectively short-circuiting the coupling electrodes and the input/output line, and resonance frequency varying means ($\mathbf{4}m_1$, $\mathbf{4}m_2$) are provided for varying the resonance frequency of the one or more resonators in association with the switch means.

20 Claims, 24 Drawing Sheets

FOREIGN PATENT DOCUMENTS

| | | |
|---|---|---|
| JP | 2005-217852 | 8/2005 |
| JP | 2005-253059 | 9/2005 |

OTHER PUBLICATIONS

Hong-Teuk Kim, et al., "Low-Loss and Compact V-Band MEMS-Based Analog Tunable Bandpass Filters", IEEE Microwave and Wireless Components Letters, vol. 12, No. 11, Nov. 2002, pp. 432-434.

E. Fourn, et al., "Bandwidth And Central Frequency Control On Tunable Bandpass Filter By Using MEMS Cantilevers", IFTU-21, 2003 IEEE MTT-S Digest, 2003, pp. 523-526.

Arnaud Pothier, et al., "Low-Loss 2-Bit Tunable Bandpass Filters Using MEMS DC Contact Switches", IEEE Transactions on Microwave Theory and Techniques, vol. 53, No. 1, Jan. 2005, pp. 354-360.

Bruce E. Carey-Smith, et al., "Wide Tuning-Range Planar Filters Using Lumped-Distributed Coupled Resonators", IEEE Transactions on Microwave Theory and Techniques, vol. 53, No. 2, Feb. 2005, pp. 777-785.

Kamran Entesari, et al., "A Differential 4-bit 6.5-10-GHz RF MEMS Tunable Filter", IEEE Transactions on Microwave Theory and Techniques, vol. 53, No. 3, Mar. 2005, pp. 1103-1110.

Kamran Entesari, et al., "A 12-18-GHz Three-Pole RF MEMS Tunable Filter", IEEE Transactions on Microwave Theory and Techniques, vol. 53, No. 8, Aug. 2005, pp. 2566-2571.

Kunihiro Kawai, et al., "Tunable Resonator Employing Comb-Shaped Transmission Line and Switches", 35$^{th}$ European Microwave Conference—Paris, 2005, pp. 193-196.

Kunihiro Kawai, et al., "Tunable Band-pass Filter Employing Comb-shaped Transmission Line Resonator", C-2-37, 2005, 4 Pages.

Kunihiri Kawai, et al., "Center-frequency and Bandwidth Tunable Band-pass Filter Employing Comb-shaped Transmission Line Resonator", C-2-35, 2006, 4 Pages.

Kunihiro Kawai, et al., "Center Frequency and Bandwidth Tunable Filter Employing Tunable Comb-Shaped Transmission Line Resonators and J-inverters", Proceedings of the 36$^{th}$ European Microwave Conference, 2006, EuMA, Manchester UK, Sep. 2006, pp. 649-652.

Kunihiro Kawai, et al., "Comb-shaped Transmission Line Tunable Resonator Employing MEMS RF Switches", C-2-77, 2006, 4 Pages.

* cited by examiner

TUNABLE FILTER

TECHNICAL FIELD

The present invention relates to a tunable filter to be mounted on a radio communication device or the like that can vary both the center frequency and the bandwidth and comprises a dielectric substrate and a transmission line of a predetermined length formed on the substrate.

BACKGROUND ART

In the field of radio communication using high frequency, signals having a particular frequency are extracted from many other signals, thereby separating necessary signals from unnecessary signals. Circuits that serve this function are referred to as a filter and used in many radio communication devices. As the frequency of the signal extracted by the filter becomes higher, the center frequency becomes higher, and the bandwidth also increases. If the bandwidth increases, the filter permits signals in the adjacent channel to pass therethrough, and this causes occurrence of an interference wave. To avoid this, it is necessary that both the center frequency and the bandwidth can be controlled and varied. A filter capable of varying both the center frequency and the bandwidth disclosed in the Patent literature 1 is shown in FIG. 31, and an operation thereof will be described below. Signals at plural frequencies are input, via an input terminal 301 and a transmission line 303, to a band control circuit 305 composed of a direct-current cut capacitor 313 and a varactor diode (a variable capacitor) 314 connected in series. A resonator 304 is connected between the output of the band control circuit 305 and the ground. The resonator 304 is composed of a parallel connection of a resonant coil 307, a resonant capacitor 308, and a series circuit composed of a capacitor 309 and a varactor diode 310. The connection point between the band control circuit 305 and the resonator 304 is connected to an output terminal 302 via a direct-current cut capacitor 306.

To raise the resonance frequency of the resonator 304, that is, the center frequency of the filter, the voltage applied to a frequency control terminal 311 for varying the capacitance of the varactor diode 310 of the resonator 304 is raised, thereby reducing the capacitance of the varactor diode 310. At this time, if the capacitance of the direct-current cut capacitor 313 on the signal input terminal remains unchanged, the bandwidth also increases. To avoid the increase of the bandwidth, the voltage applied to a band control terminal 315 of the varactor diode 314 of the band control circuit 305 is also raised, thereby reducing the capacitance of the varactor diode 314. As a result, the increase of the bandwidth caused by increasing the center frequency of the filter can be prevented. There has been proposed a filter that can vary both the center frequency and the bandwidth to a desired value by varying the coupling capacitance of the resonator.

However, as can be seen from the circuit diagram of FIG. 31, this filter is composed of lumped constant elements, and it is difficult to use the filter in the microwave band used for mobile communication as it is, for example. In addition, this filter varies the resonance frequency by varying the capacitance of the varactor diodes. However, the temperature characteristics of the capacitance of such a device is unstable, so that the reproducibility of the resonance frequency is low. Thus, for example, the applicant has disclosed a distributed constant circuit filter used in the microwave band and a method of varying the resonance frequency in Patent literature 2 and Non-patent literature 1.

However, the distributed constant circuit filter described above cannot control the bandwidth, although the filter can vary the center frequency.

Patent literature 1: Japanese Patent Application Laid-Open No. 2002-9573 (FIG. 1)

Patent literature 2: Japanese Patent Application Laid-Open No. 2005-253059 (FIG. 1)

Non-patent literature 1: The institute of electronics, information and communication engineers, general conference C-2-37, 2005

DISCLOSURE OF THE INVENTION

The present invention has been devised in view of such problems, and an object of the present invention is to provide a tunable filter that can easily control both the bandwidth and the center frequency with high reproducibility, has a simple structure, and can operate in the microwave band.

A tunable filter according to the present invention comprises:

an input/output line formed on a dielectric substrate;

at least two coupling sections formed in the input/output line at a distance from each other in the longitudinal direction of the input/output line, each of the coupling sections having a gap formed in the input/output line and one or more coupling electrodes arranged in the gap in the longitudinal direction of the input/output line;

a resonator capable of varying the resonance frequency that is connected to the input/output line between every adjacent two of said coupling sections;

switch means for selectively grounding the coupling electrodes of the coupling sections and/or selectively short-circuiting the coupling electrodes or the coupling electrodes and the input/output line; and resonance frequency varying means for varying the resonance frequency of the resonator in association with the switch means.

As described above, according to the present invention, both the bandwidth and the center frequency can be arbitrarily controlled by varying the degree of coupling between the resonators and/or between the resonators and the input/output line by the switch means and adjusting the resonance frequency of the resonators in response to the degree of coupling. This control can be conducted using the coupling electrodes and the switch means having simple structures, so that, the tunable filter can vary both the bandwidth and the center frequency with high reproducibility.

BEST MODES FOR CARRYING OUT THE INVENTION

Figure 1B:
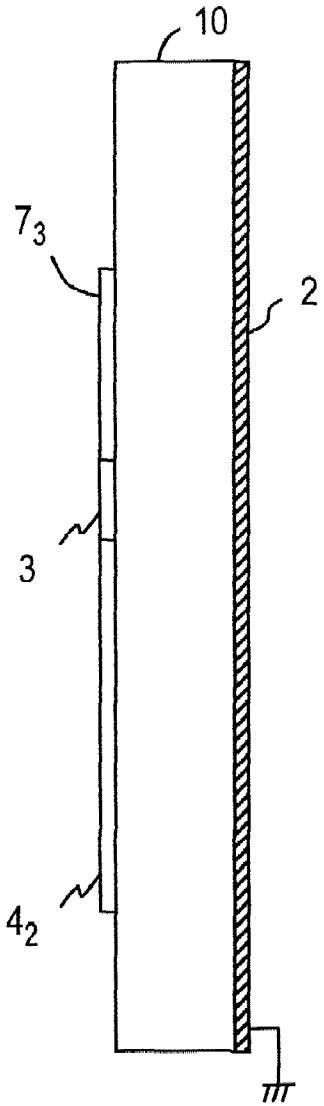
FIG. 1B is a side view of the basic configuration shown in FIG. 1A.

In the following, embodiments of the present invention will be described with reference to the drawings. The same parts are denoted by the same reference numerals, and redundant descriptions thereof will be omitted.

Basic Embodiment of Invention

Figure 1A:
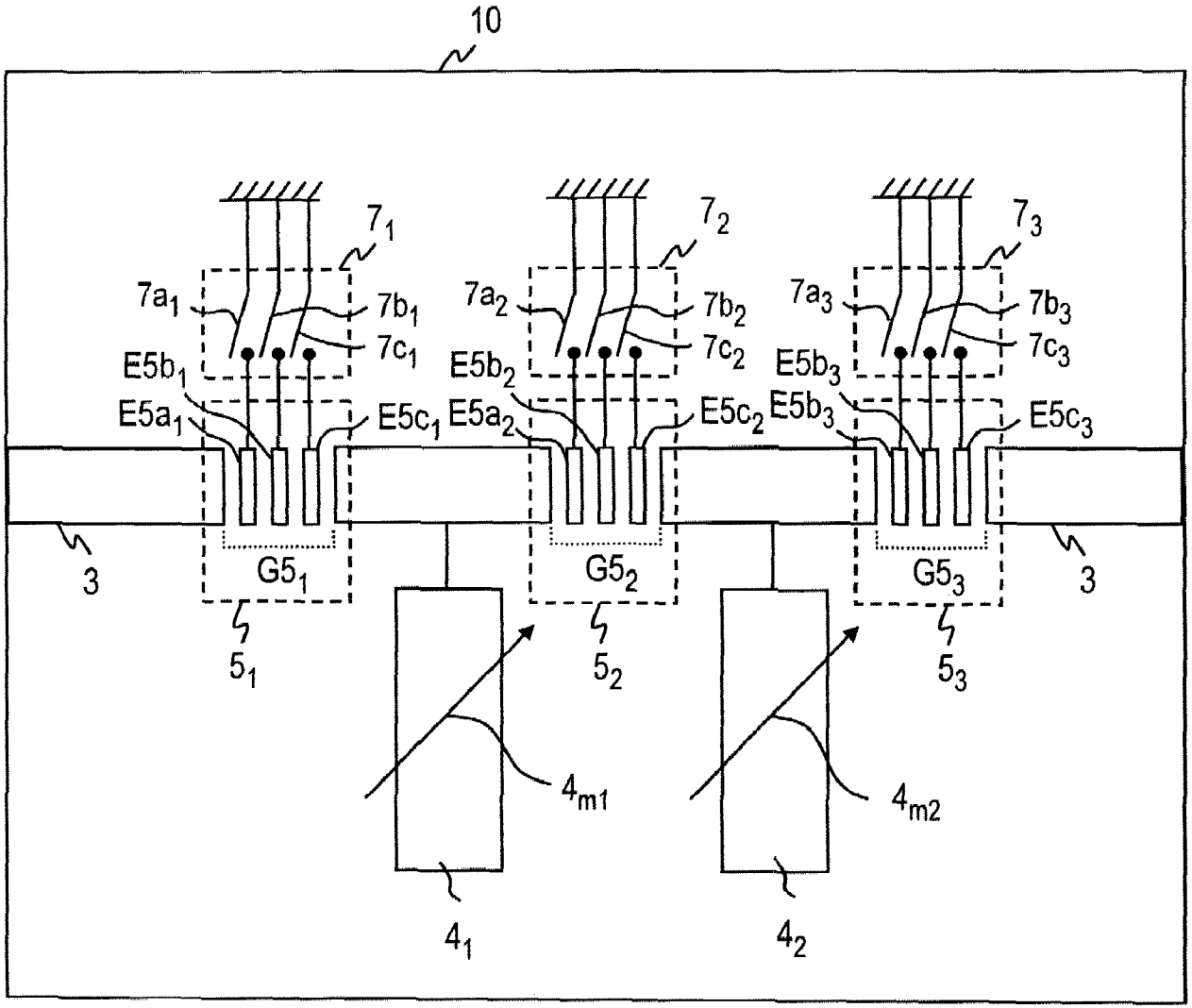
FIG. 1A is a plan view showing a basic configuration of the present invention.

FIG. 1A is a diagram for illustrating the basic concept of a tunable filter according to an embodiment of the present invention. FIG. 1B is a side view of the tunable filter. According to this embodiment, the tunable filter is composed of a microstrip line. One surface of a rectangular dielectric substrate 10 is covered with a grounding conductor 2 to be connected to the ground potential. An input/output line 3 is formed across the middle of the dielectric substrate 10 on the surface of the dielectric substrate 10 opposite to the grounding conductor 2. According to this embodiment, a resonator capable of varying the resonance frequency is composed of a distributed constant circuit. One or more, two in this embodiment, resonators $\mathbf{4}_1$ and $\mathbf{4}_2$ each composed of a line capable of varying the resonant line length and provided along the input/output line 3 are connected to one side edge of the input/output line 3. The input/output line 3 has coupling sections $\mathbf{5}_1$ and $\mathbf{5}_2$ for the resonators $\mathbf{4}_1$ and $\mathbf{4}_2$, respectively, that are located at positions shifted from the respective resonators $\mathbf{4}_1$ and $\mathbf{4}_2$ toward one end of the input/output line 3. The input/output line has another coupling section $\mathbf{5}_3$ at a position shifted from the resonator closest to the other end of the input/output line 3, i.e., the resonator $\mathbf{4}_2$ in this embodiment, toward the other end of the input/output line 3. The coupling sections $\mathbf{5}_1$, $\mathbf{5}_2$ and $\mathbf{5}_3$ are composed of gaps $G\mathbf{5}_1$, $G\mathbf{5}_2$ and $G\mathbf{5}_3$, respectively, which are formed in the input/output line and rectangular coupling electrodes $E\mathbf{5}^*_1$, $E\mathbf{5}^*_2$ and $E\mathbf{5}^*_3$ that are longer in the width direction of the input/output line 3 and arranged in the gaps $G\mathbf{5}_1$, $G\mathbf{5}_2$ and $G\mathbf{5}_3$, respectively, along the length of the input/output line 3. Here, the symbol "*" will be described. In this embodiment, there are three coupling electrodes, and therefore, the symbol "*" represents characters "a", "b" and "c". That is, there are provided coupling electrodes $E\mathbf{5}a_1$, $E\mathbf{5}b_1$, $E\mathbf{5}c_1$; $E\mathbf{5}a_2$, $E\mathbf{5}b_2$, and $E\mathbf{5}c_2$; and $E\mathbf{5}a_3$, $E\mathbf{5}b_3$, and $E\mathbf{5}c_3$. In the following, the same symbol "*" will be used to collectively represent a plurality of same items. In this embodiment, in order to control the degree of coupling between the input/output line 3 and the resonators or between the adjacent resonators, switch means $\mathbf{7}^*_1$, $\mathbf{7}^*_2$ and $\mathbf{7}^*_3$ for connecting the coupling electrodes $E\mathbf{5}^*_1$, $E\mathbf{5}^*_2$ and $E\mathbf{5}^*_3$ of the coupling sections $\mathbf{5}_1$, $\mathbf{5}_2$ and $\mathbf{5}_3$ to the grounding conductor 2 via an interlayer connection (via hole) (not shown) are provided at one end of the coupling electrodes $E\mathbf{5}^*_1$, $E\mathbf{5}^*_2$ and $E\mathbf{5}^*_3$. In the following, the grounding switch of this kind will be referred to as shunt switch. There are provided resonance frequency varying means $4m_1$, and $4m_2$ capable of varying the line length, which determines the resonance frequency of the resonators $4_1$ and $4_2$, in association with the switch means $7^*_1$, $7^*_2$ and $7^*_3$. As described in detail later, the switch means $7^*_1$, $7^*_2$ and $7^*_3$ may be a short-circuit switch that selectively short-circuits the coupling electrodes or the coupling electrodes and the input/output line.

Basic Principle of Invention

Figure 2:
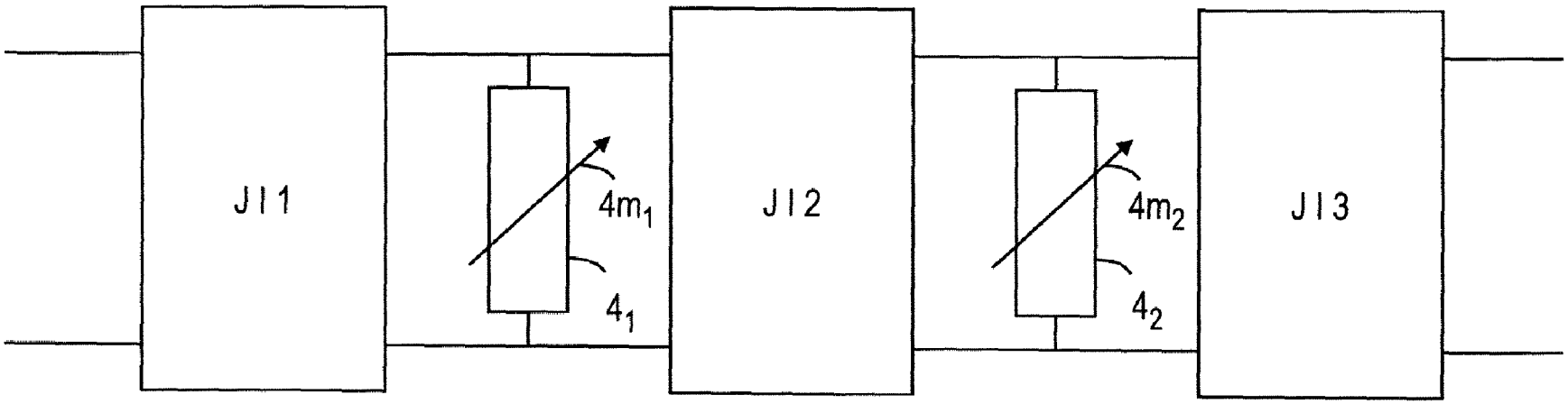
FIG. 2 is a diagram showing an equivalent circuit using J-inverters of the basic configuration shown in FIG. 1A.

The basic arrangement according to this embodiment of the present invention shown in FIG. 1 can be represented as an equivalent circuit using J-inverters as shown in FIG. 2. Specifically, J-inverters JI1, JI2 and JI3 are connected in series by transmission lines, and the resonator $4_1$ is connected between the transmission lines between the J-inverters JI1 and JI2, and the resonator $4_2$ is connected between the transmission lines between the J-inverters JI2 and JI3. The J-inverter is a virtual transmission line that has a characteristic admittance of J and has a length equal to λ/4 at all frequencies (λ represents the wavelength at each frequency). Herein after, the admittance parameter of a J-inverter will be referred to simply as J value. The J-inverters JI1, JI2 and JI3 correspond to the coupling sections $5_1$, $5_2$ and 53, respectively. For simplicity, it is supposed that the input/output lines have an equal characteristic admittance of $Y_0$ and are terminated with an admittance $Y_0$. Supposing that the J value of the J inverter JI1 is J1, the J value of the J inverter JI2 is J2, and the J value of the J inverter JI3 is J3, the J values are expressed by the following equations.

$$J1 = \sqrt{\frac{Y_0 b_1 w}{g_0 g_1}} \tag{1}$$

$$J2 = \sqrt{\frac{b_1 b_2}{g_1 g_2}} \tag{2}$$

$$J3 = \sqrt{\frac{Y_0 b_2 w}{g_2 g_3}} \tag{3}$$

In these equations, a character "w" denotes the fractional bandwidth (the bandwidth in Hertz divided by the center frequency), a character "$g_k$" (k=0, 1, 2, 3) denotes the element value of a prototype low-pass filter, and a character "$b_i$" denotes the susceptance slope parameter of the tunable resonator $4_i$. Supposing that the admittance of the tunable resonator $4_i$ is expressed as $Y_{ri}=G_{ri}+jB_{ri}$, the susceptance slope parameter $b_i$ (i=1, 2) is expressed by the following equation (4).

$$b_i = \frac{\omega_0}{2}\frac{\partial B_{ri}}{\partial \omega}\Big|_{\omega_0} \tag{4}$$

In this equation, a character "$\omega_0$" denotes the resonance angular frequency of the tunable resonator $4_i$. As shown by the equations (1) to (3), the J values J1, J2 and J3 are functions of the fractional bandwidth w. To achieve a desired fractional bandwidth w, the J values J1, J2 and J3 can be adjusted according to the resonance frequency of the tunable resonator $4_i$, that is, the susceptance slope parameter bi associated with the center frequency.

Figure 3B:
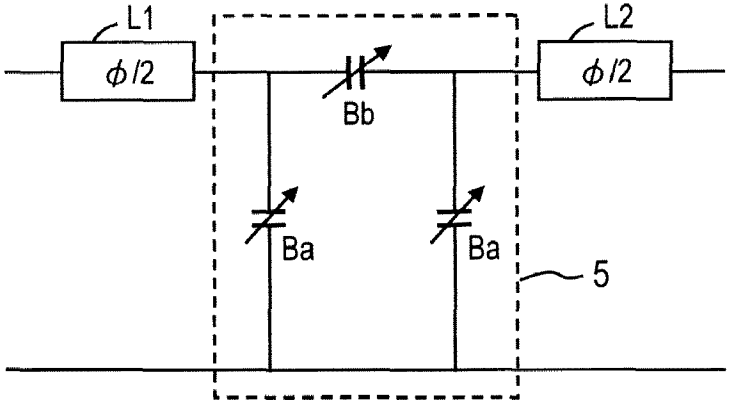
FIG. 3B shows a J-inverter equivalent circuit of the coupling section.
Figure 3A:
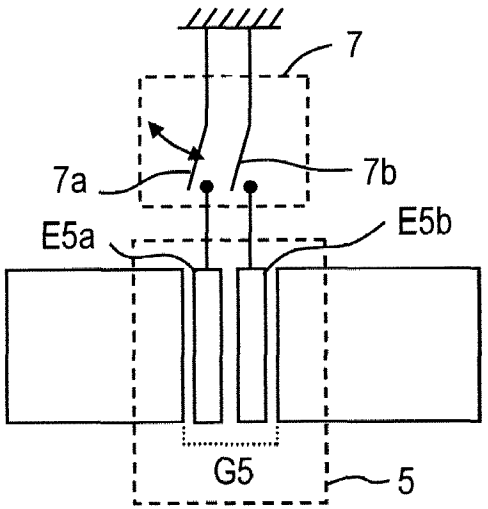
FIG. 3A shows a specific example of electrodes of a coupling section.

FIG. 3A shows electrodes of an exemplary coupling section 5. In this drawing, two coupling electrodes E5*a* and E5*b* are provided in a gap G5 and are grounded at one end via shunt switch elements 7*a* and 7*b*, respectively. FIG. 3B is a diagram showing a J-inverter equivalent circuit of the coupling section 5. The coupling section 5 can be represented by a π network composed of susceptance elements Ba and Bb and is essentially capacitive. As can be apparent from FIG. 3B, to function as the J-inverter, the coupling section 5 has to have transmission lines L1 and L2 at the input and output ends thereof.

Figure 3C:
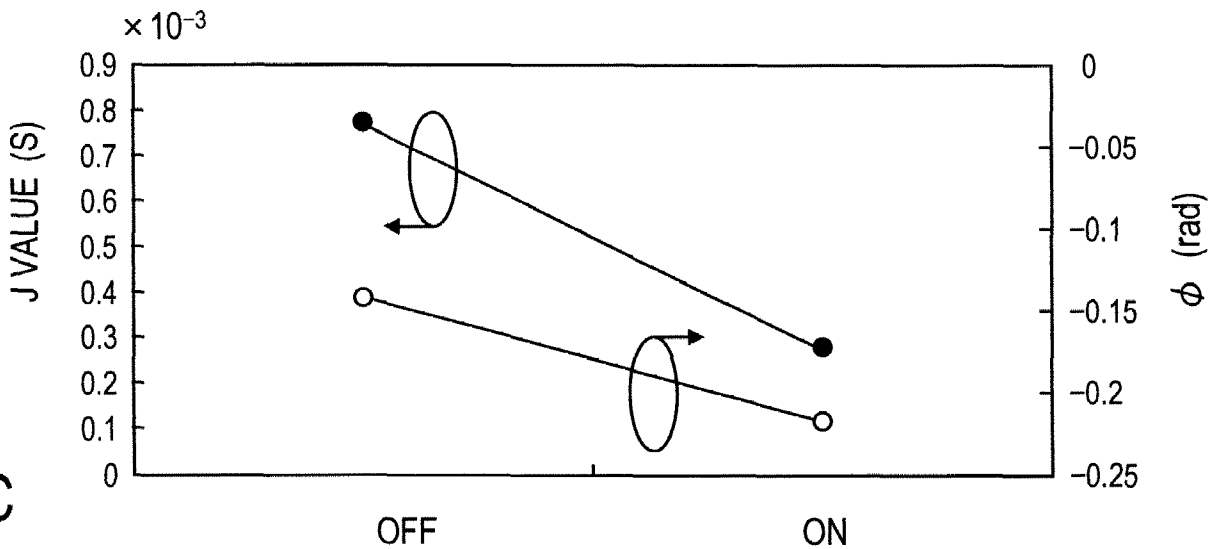
FIG. 3C is a graph showing a variation of the J value when switch elements are turned on and off.

FIG. 3C is a graph showing a variation in J value in the case where the coupling section 5 shown in FIG. 3A is composed of an alumina ($Al_2O_3$) substrate and gold (Au) electrodes of a predetermined size and the shunt switch elements 7*a* and 7*b* are turned on and off. The left-side ordinate indicates the J value in siemens (S), and the right-side ordinate indicates, in rad, the electrical length ϕ of the transmission line required to make the coupling section function as the J-inverter, or in other words the adjusting electrical length for providing an equivalent electrical length of the coupling section 5 of λ/4. When the shunt switch elements 7*a* and 7*b* are off, the J value is about $0.77\times10^{-3}$. When the shunt switch elements 7*a* and 7*b* are on, the J value decreases by about $0.5\times10^{-3}$ to about $0.27\times10^{-3}$. As is apparent from the equation (1), if the J value decreases, the fractional bandwidth w is reduced. In this case, the adjusting electrical length of the transmission line varies from about −0.16 rad to −0.28 rad. Since the line length cannot have a negative value, the adjustment is conducted by reducing the line length of the resonator connected to the coupling section 5. In this case, the amount of variation is about −0.12 rad, and therefore, the adjustment is conducted by reducing the line length of the resonator of the equivalent circuit shown in FIG. 3B by −0.12/2 rad, or about 0.01λ. In this way, the bandwidth of the resonator can be arbitrarily varied if the coupling section composed of a gap formed in a transmission line and simple coupling electrodes shown in FIG. 3A, the switch means for controlling the coupling electrodes, and the resonator capable of varying the resonant line length are combined with each other. Of course, the center frequency can be varied to any value.

Embodiment 1

Figure 4A:
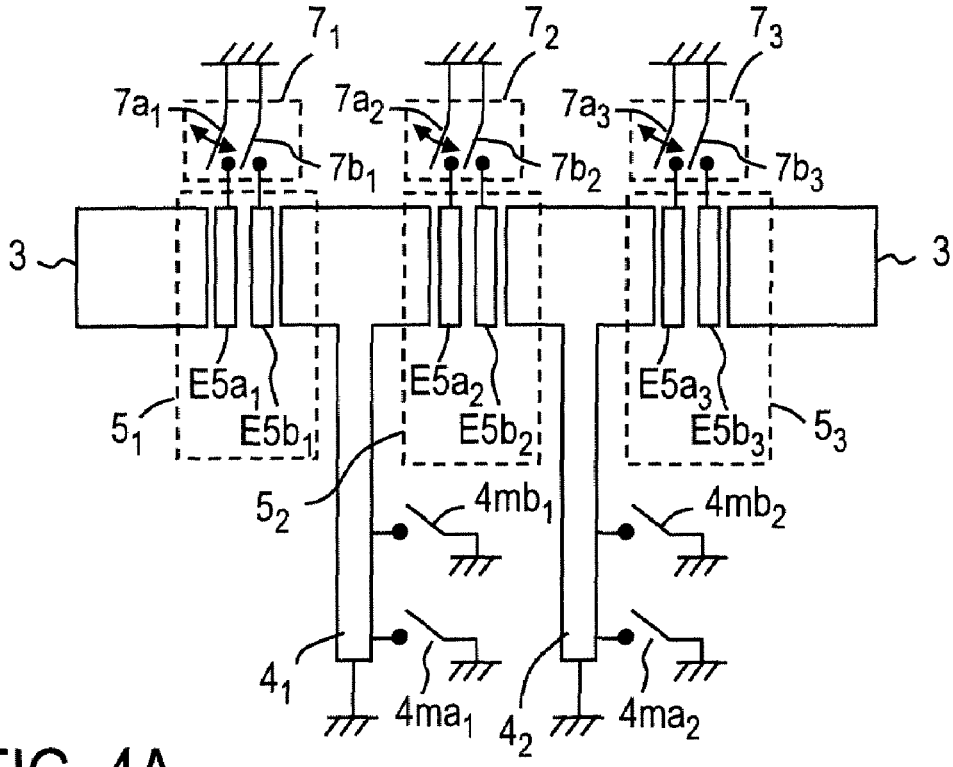
FIG. 4A shows a configuration of a tunable filter according to an embodiment 1 of the present invention.

FIG. 4A shows a tunable filter according to an embodiment 1 of the present invention. According to this embodiment, the coupling sections $5_1$, $5_2$ and $5_3$ shown in FIG. 1 each have two coupling electrodes, and the resonators $4_1$ and $4_2$ are tip-short-circuited quarter-wave stubs having equal lengths and a characteristic impedance of 50 Ω. The fractional bandwidth is 8.5% when all the shunt switch elements of the switch means $7_1$, $7_2$ and $7_3$ are turned off, 4.4% when the switch elements $7a_1$, $7a_2$ and $7a_3$ are turned on, and 3.0% when the switch elements $7b_1$, $7b_2$ and $7b_3$ are turned on. For each of these cases, the J values of the J-inverters and the line lengths of the resonators $4_1$ and $4_2$ required to make the coupling sections function as a J-inverter are determined. The table 1 shows the results.

TABLE 1

| Fractional Bandwidth (%) | J1, J3 ($S\times10^{-3}$) | J2 ($S\times10^{-3}$) | Line length of resonator $4_1$ | Line length of resonator $4_2$ |
|---|---|---|---|---|
| 8.5 | 4.34 | 0.94 | λ/4 | λ/4 |
| 4.4 | 3.12 | 0.48 | λ/4 × 0.95 | λ/4 × 0.93 |
| 3.0 | 2.58 | 0.33 | λ/4 × 0.85 | λ/4 × 0.85 |

As resonance frequency varying means $4m_1$ of the resonator $4_1$, a shunt switch $4ma_1$ that reduces the line length to 95% and a shunt switch $4mb_1$ that reduces the line length to 85% are provided. As resonance frequency varying means $4m_2$ of the resonator $4_2$, a shunt switch $4ma_2$ that reduces the line length to 93% and a shunt switch $4mb_2$ that reduces the line length to 85% are provided. The line length of the resonator $4_2$ is reduced to 93%, which is 2% smaller than the line length of the resonator $4_1$. This is intended to compensate for the asymmetry of the input/output line about each resonator $4_1$, $4_2$ due to the coupling electrodes E$5a_1$, E$5a_2$ and E$5a_3$ of the coupling sections $5_1$, $5_2$ and $5_3$ closest to one end of the input/output line 3 being grounded.

Figure 4B:
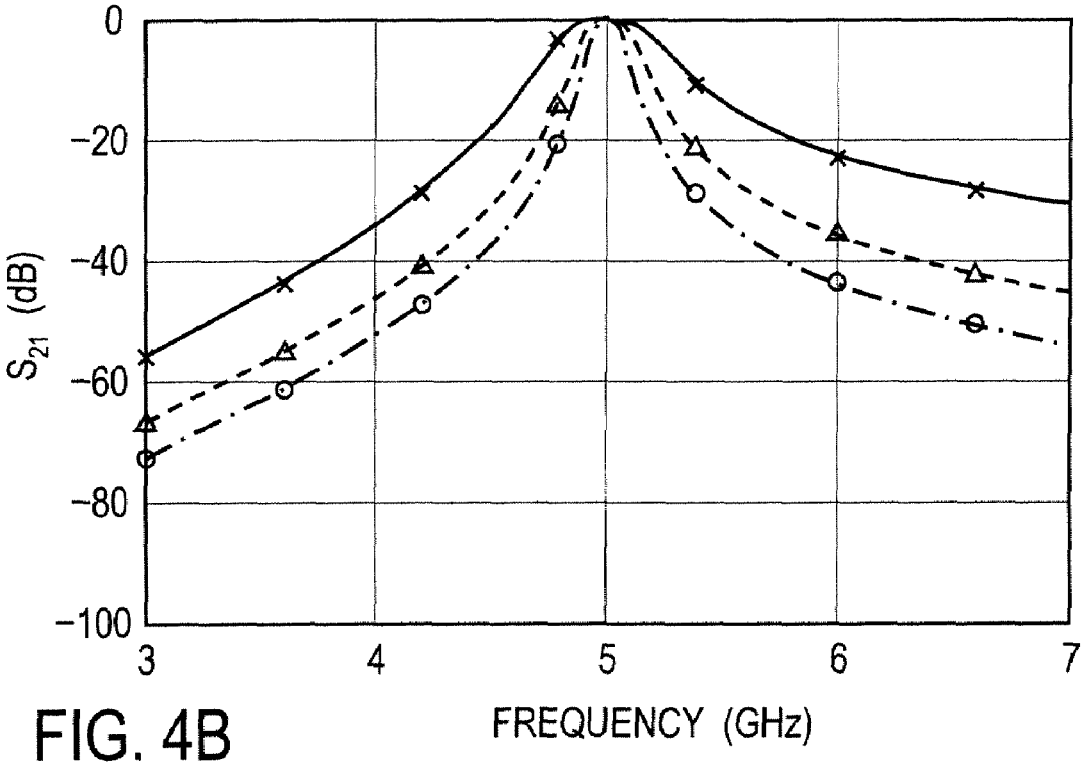
FIG. 4B shows the transmission characteristics in the embodiment 1 using an S parameter.

FIG. 4B shows, in terms of S parameter, the transmission characteristics of the tunable filter according to the embodiment 1 in the solid line in the case where the shunt switch elements $7^*_1$, $7^*_2$ and $7^*_3$ and the shunt switches $4ma_1$, $4mb_1$, $4ma_2$ and $4mb_2$ are all turned off. The abscissa in FIG. 4B indicates the frequency, and the ordinate indicates the S parameter $S_{21}$, which represents, in dB, the ratio between the signals input to one end of the input/output line 3 and the signals transmitted to the other end of the input/output line 3. The solid line shows the transmission characteristics in the case where the fractional bandwidth is 8.5%. The dashed line shows the transmission characteristics in the case where the switch means $7a_1$, $7a_2$ and $7a_3$ and the shunt switches $4ma_1$ and $4ma_2$ are turned on. In this case, the fractional bandwidth is 4.4%. The alternate long and short dash line shows the transmission characteristics in the case where the shunt switch elements $7^*_1$, $7^*_2$ and $7^*_3$ and the shunt switches $4ma_1$, $4mb_1$, $4ma_2$ and $4mb_2$ are all turned on. In this case, the fractional bandwidth is 3.0%. In this case, the line length of the resonators $4_1$ and $4_2$ is determined by the state of the shunt switches $4mb_1$ and $4mb_2$, and therefore, the shunt switches $4ma_1$ and $4ma_2$ can be in any state. In this case, the input/output line 3 is symmetric about each resonator $4_1$, $4_2$, and therefore, the resonators $4_1$ and $4_2$ have an equal line length of 85%. In this way, the bandwidth can be controlled without varying the center frequency. Of course, the center frequency and the bandwidth can be both varied.

According to the embodiment 1 shown in FIG. 4A, two resonators $4_1$ and $4_2$ are used, and the coupling sections $5_1$, $5_2$ and $5_3$ each have two coupling electrodes. However, three or more resonators may be connected to the input/output line 3. In addition, the number of coupling electrodes and the arrangement thereof may be modified according to the amount of variation of the bandwidth, the step size of adjustment, or the like. In the following, modifications of the electrode arrangement of the coupling section, which are embodiments of the present invention, will be described.

Embodiment 2

Figure 5:
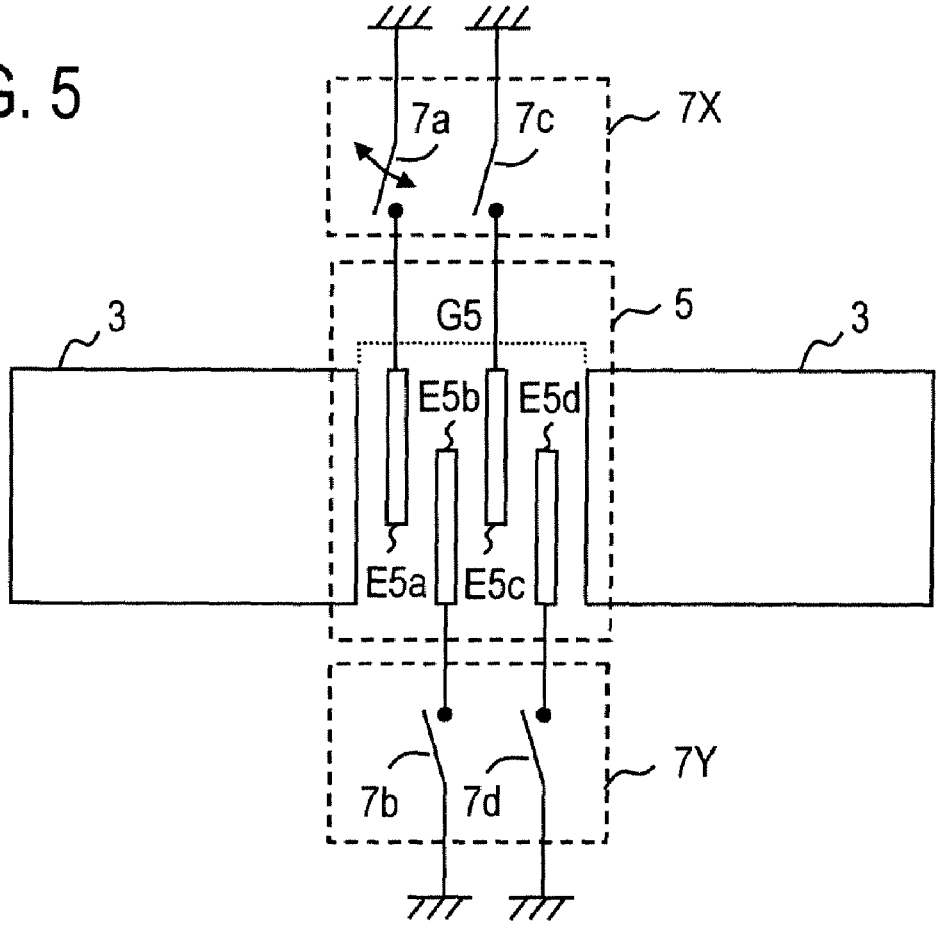
FIG. 5 is a diagram showing a configuration of electrodes of a coupling section according to an embodiment 2.

FIG. 5 shows a coupling section according to an embodiment 2, in which the adjustment step size of the J value is reduced. A coupling section 5 is composed of coupling electrodes E5*a*, E5*b*, E5*c* and E5*d* that are arranged in a gap G5 formed in the input/output line 3 in the longitudinal direction thereof in such a manner that the coupling electrodes are partially opposed to each other. That is, the length of the coupling electrodes E5*a* to E5*d* in the width direction of the input/output line 3 is shorter than the line width of the input/output line 3. The coupling electrodes E5*a* and E5*c* are grounded at one end via shunt switch elements 7*a* and 7*c* of switch means 7X, respectively. The coupling electrodes E5*b* and E5*d* are grounded at an end on the side opposite to the switch means 7X via shunt switch elements 7*b* and 7*d* of switch means 7Y, respectively. The line width of the input/output line 3 is about 1 mm, for example. Thus, the coupling section 5 according to the embodiment 2 can adjust the J value in smaller adjustment steps in an 25 extremely small space. In addition, since the length of the coupling electrodes E5*a* to E5*d* is shorter than the width of the input/output line 3, and the adjacent coupling electrodes are only partially opposed to each other, the J value can be adjusted more finely.

FIG. 5 shows an example in which all the coupling electrodes are partially opposed to each other. However, depending on the design, only some of the coupling electrodes are opposed to each other, and others may be opposed to each other along the entire length thereof.

Embodiment 3

Figure 6:
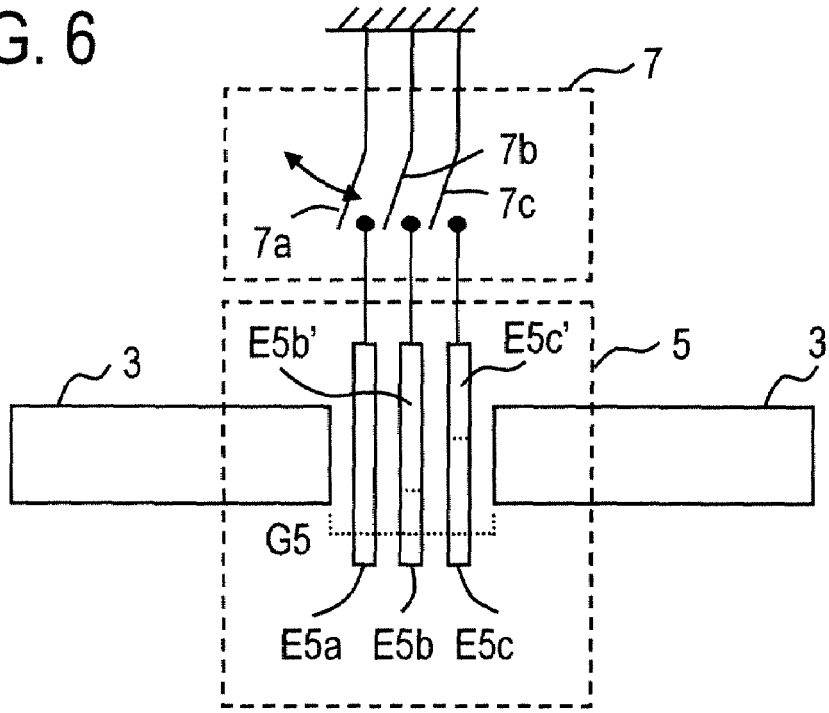
FIG. 6 is a diagram showing a configuration of electrodes of a coupling section according to an embodiment 3.

FIG. 6 shows a coupling section according to an embodiment 3, in which the adjustment sensitivity of the J value is improved. A coupling section 5 is composed of coupling electrodes E5*a*, E5*b* and E5*c* longer than the line width of the input/output line 3 that are arranged in a gap G5 formed in the input/output line 3. The coupling electrodes of the coupling section 5 are grounded at one end via shunt switch elements 7*a*, 7*b* and 7*c* of switch means 7, respectively. The opposed ends of the input/output line 3 on the opposite sides of the gap G5 are coupled to each other by lines of electric force produced according to the Gauss' law. Since the lines of electric force have a property that they emerge perpendicularly from and are incident perpendicularly on the surface of the conductor, the lines of electric force travel in straight lines between the opposed ends of the input/output line 3. However, the lines of electric force emerging from the opposite sides of the input/output line 3 travel between the opposed ends of the input/output line 3 in an arc that curves outwardly from the longitudinal center of the input/output line 3 because of the property described above. Since the coupling electrodes of the coupling section is longer than the line width of the input/output line 3, the coupling electrodes E5*a*, E5*b* and E5*c* can catch the arc-shaped lines of electric force in the gap G5. As a result, the coupling electrodes control an increased number of lines of electric force, and thus, the sensitivity of the J value is increased. For example, if the coupling electrodes E5*a* to E5*c* are two times longer than the line width of the input/output line 3, the amount of variation of the J value can be increased by 4%. Thus, the coupling electrodes configured as in the embodiment 2 can increase the control sensitivity of the J value.

FIG. 6 shows a case where all the coupling electrodes are longer than the width of the input/output line. However, only some of the coupling electrodes may be longer than the width of the input/output line, and the remaining coupling electrodes may have a length equal to the width of the input/output line.

In addition, if the length of some of the coupling electrodes is reduced, such as coupling electrodes E5*b*' and E5*c*' shown by the dashed line in FIG. 6, the number of lines of electric force that can be controlled decreases, and therefore, the amount of control of the J value decreases. In this way, the amount of variation of the J value can be controlled by varying the length of the coupling electrodes.

Embodiment 4

Figure 7A:
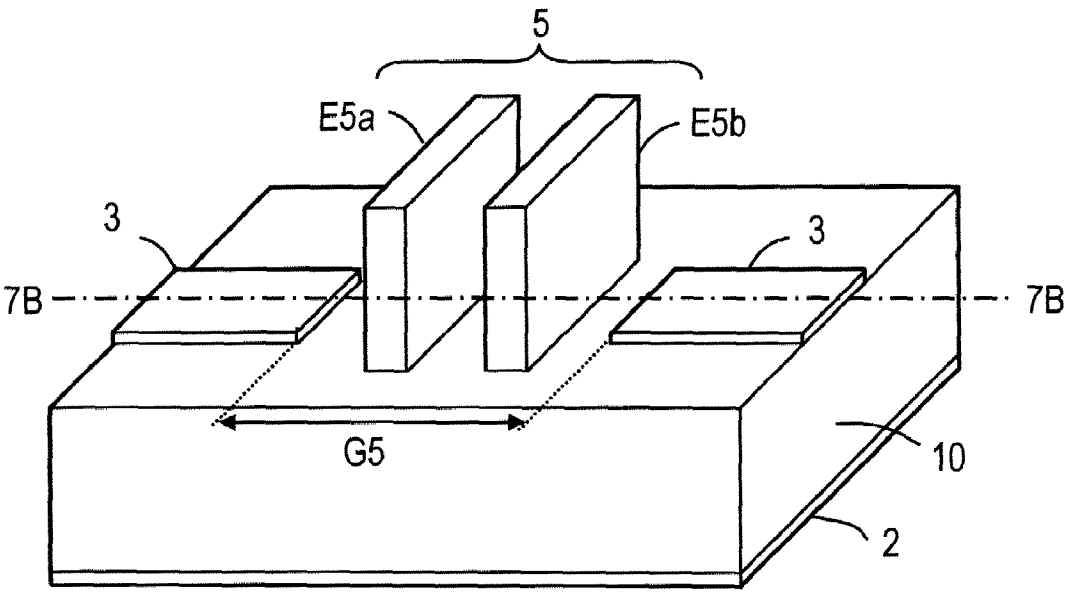
FIG. 7A is a perspective view showing an embodiment 4, in which coupling electrodes have a three-dimensional structure.
Figure 7B:
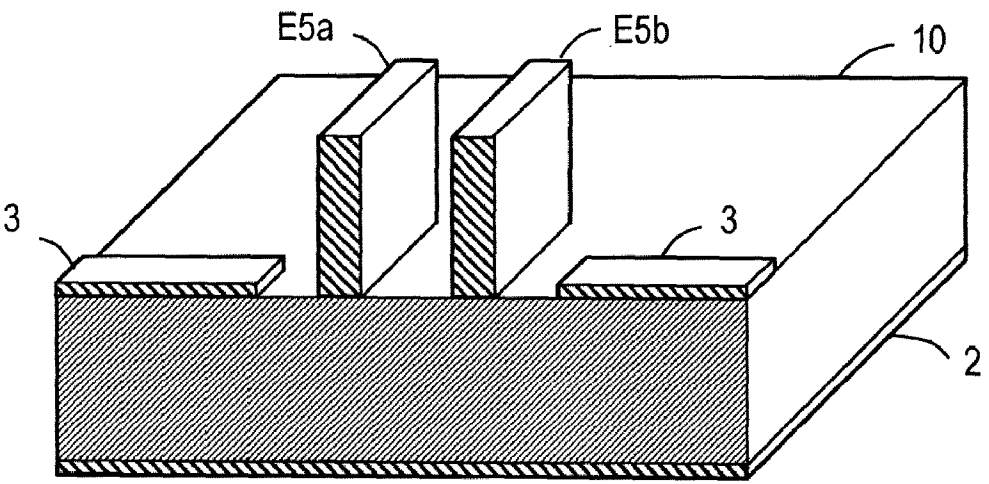
FIG. 7B is a cross-sectional view taken along the line 7B-7B in FIG. 7A.

FIG. 7A is a perspective view showing an embodiment 4, in which coupling electrodes have a three-dimensional structure to use more lines of electric force. A coupling section 5 comprises coupling electrodes E5*a* and E5*b* having a length greater than the line width of an input/output line 3 and a 25 certain height from the surface of a dielectric substrate 10 that are arranged in a gap G5 formed in the input/output line 3. FIG. 7B is a cross-sectional view taken along the line 7B-7B in FIG. 7A. In FIGS. 7A and 7B, switch means are not shown. Such coupling electrodes having a certain height can be produced by application of the micromachining art. The method of producing the coupling electrodes is not essential in this application and therefore will be described only briefly. After the input/output line 3 is formed, a sacrifice layer having a height equal to that of the coupling electrodes E5*a* and E5*b* is formed on the surface of the dielectric substrate 10. Then, windows extending from the surface of the sacrifice layer to the surface of the dielectric substrate 10 for forming the coupling electrodes are formed in the sacrifice layer by photoprocessing, and then, an electrode film of gold or the like is formed over the sacrifice layer by vapor deposition or sputtering. Then, the electrode film except the parts to form the coupling electrodes E5*a* and E5*b* and the sacrifice layer are etched, thereby forming the coupling electrodes having a three-dimensional structure.

Since the coupling electrodes have a three-dimensional structure, the coupling electrodes can catch the lines of electric force traveling in the three-dimensional space between the ends of the input/output line 3 opposed to each other via the gap G5. Thus, the three-dimensional structure can have a higher control sensitivity of the J value than the planer structure.

Embodiment 5

Figure 8A:
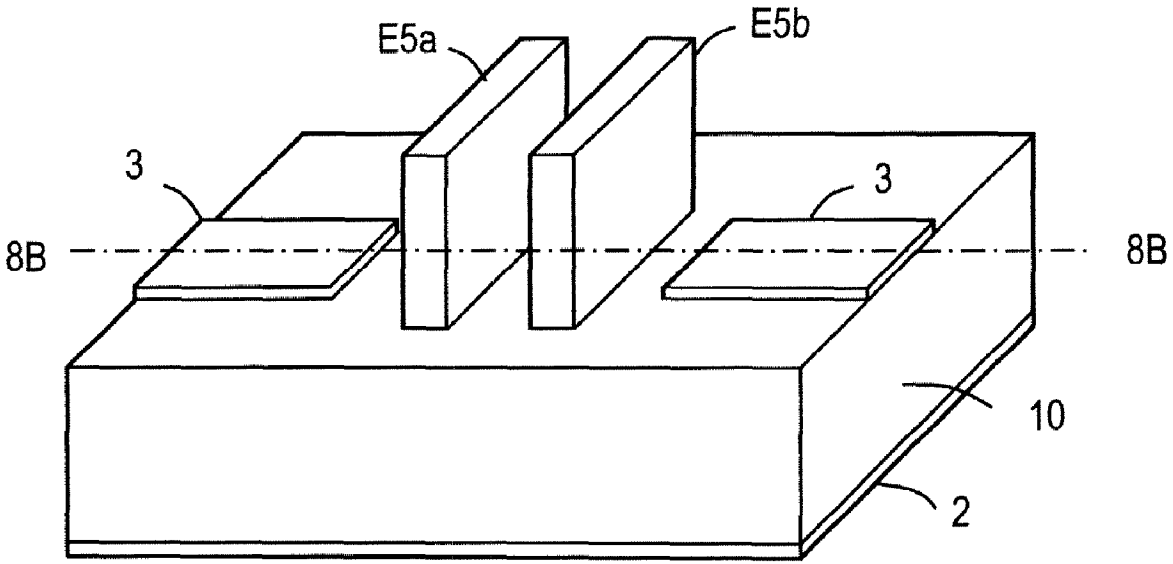
FIG. 8A is a perspective view showing an embodiment 5, in which coupling electrodes have a three-dimensional structure.
Figure 8B:
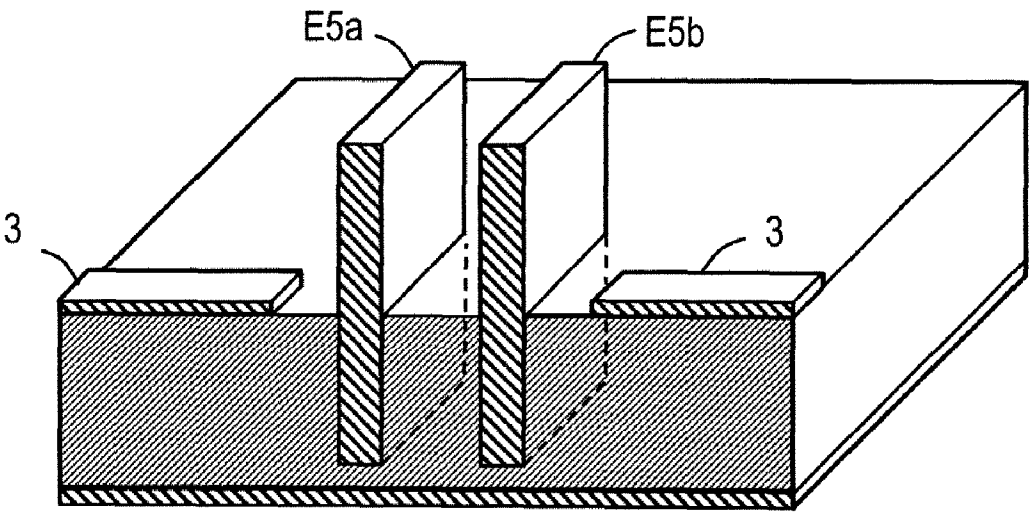
FIG. 8B is a cross-sectional view taken along the line 8B-8B in FIG. 8A.

FIG. 8A shows another embodiment in which coupling electrodes have a three-dimensional structure. The perspective view of FIG. 8A is similar to FIG. 7 described above. However, as can be seen from the cross-sectional view of FIG. 8B, which is taken along the line 8B-8B in FIG. 8A, coupling electrodes E5*a* and E5*b* differ from those in FIG. 7 in that the coupling electrodes E5*a* and E5*b* extend into the dielectric substrate 10. The coupling electrodes E5*a* and E5*b* thus configured can catch the lines of electric force traveling inside the dielectric substrate 10, and therefore, the control sensitivity of the J value can be increased. The coupling electrodes shown in FIG. 8B can also be produced by the micromachining art described above.

Embodiment 6

Figure 9:
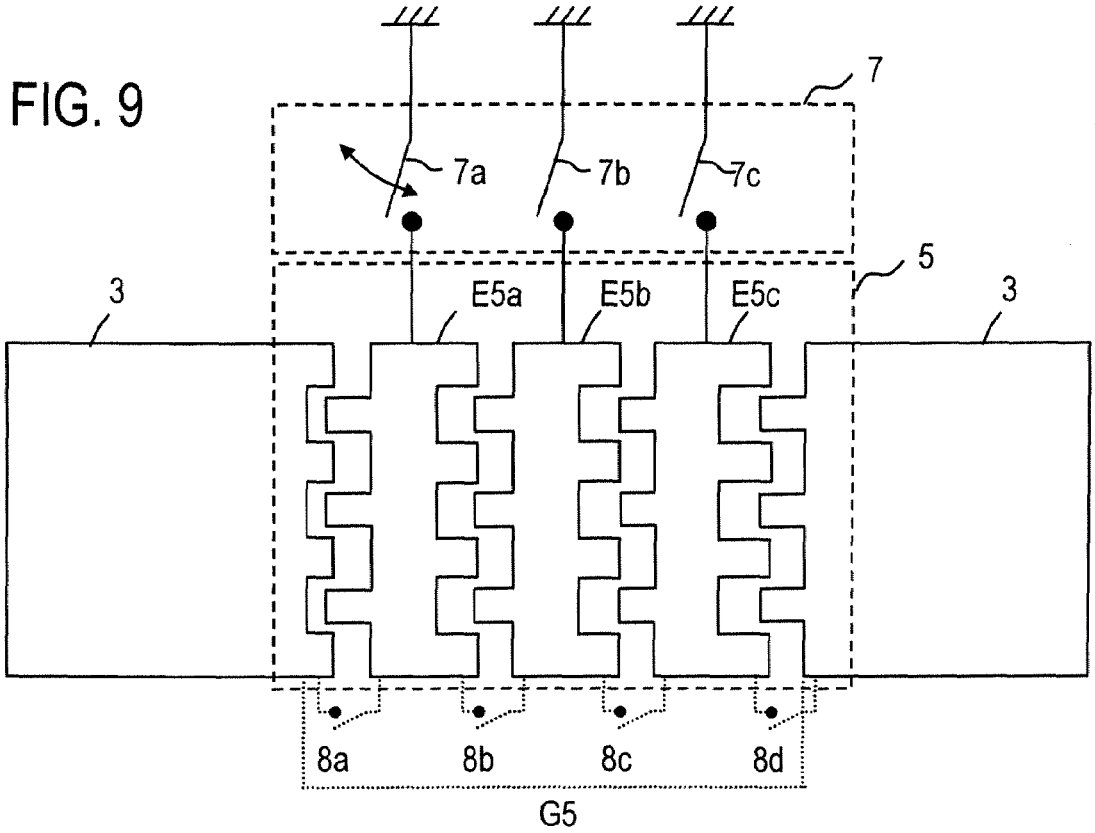
FIG. 9 is a diagram showing a configuration of electrodes of a coupling section according to an embodiment 6.

FIG. 9 shows a structure of coupling electrodes that enhances the degree of coupling between the coupling electrodes. The ends of an input/output line 3 opposed to each other via a gap G5 are comb-shaped, and a coupling section 5 is composed of coupling electrodes E5*a*, E5*b* and E5*c* whose opposite ends in the longitudinal direction of the input/output line 3 are formed into a comb shape so that the coupling electrodes mesh with each other and with the opposed ends of the input/output line 3. The coupling electrodes E5*a*, E5*b* and E5*c* of the coupling section 5 are grounded at one end via shunt switch elements 7*a*, 7*b* and 7*c* of switch means 7, respectively. If the gap G5 and the coupling electrodes E5*a*, E5*b* and E5*c* are configured as described above, the length of the opposed edges of the coupling electrodes can be increased within a limited space, and therefore, the control sensitivity of the J value can be further increased. This comb-shaped electrode structure is referred to also as interdigital gap structure.

Embodiment 7

Figure 10:
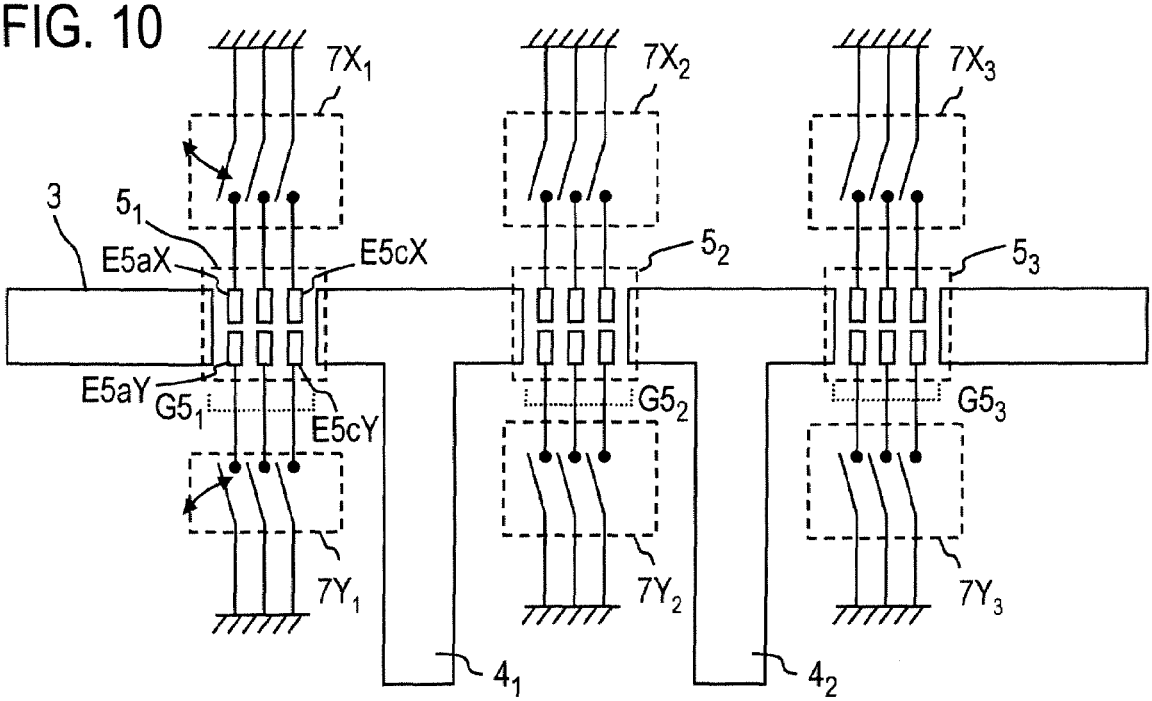
FIG. 10 is a diagram showing an embodiment 7, in which the length of coupling electrodes of a first coupling section and a second coupling section in the embodiment 1 (FIG. 1) is divided into two in the middle of the width of an input/output line, thereby reducing the control step size of the J value.

FIG. 10 shows an embodiment 7, in which the coupling electrodes of the coupling sections in the embodiment 1 (FIG. 1) are divided into two parts in the middle of the width of the input/output line 3 to reduce the control step size of the J value. The coupling electrode E5*a*$_1$ of the coupling section 5$_1$ (FIG. 1) is divided as shown in FIG. 10 into two coupling electrodes E5*a*X$_1$ and E5*a*Y$_1$. Similarly, the coupling electrode E5*b*$_1$ is divided into coupling electrodes E5*b*X$_1$ and E5*b*Y$_1$, and the coupling electrode E5*c*$_1$ is divided into coupling electrodes E5*c*X$_1$ and E5*c*Y$_1$. The coupling electrodes of the coupling sections 5$_2$ and 5$_3$ are also divided into two parts in the same manner. There are provided switch means 7X$_1$, 7X$_2$ and 7X$_3$ for selectively grounding one of the resulting two coupling electrodes and switch means 7Y$_1$, 7Y$_2$ and 7Y$_3$ for selecting the other of the resulting two coupling electrodes. Resonance frequency varying means 4*m*$_1$ and 4*m*$_2$ are not shown. The coupling sections configured in this way can control the J value in smaller steps within the limited space of gaps G5$_1$, G5$_2$ and G5$_3$.

Embodiment 8

Figure 11:
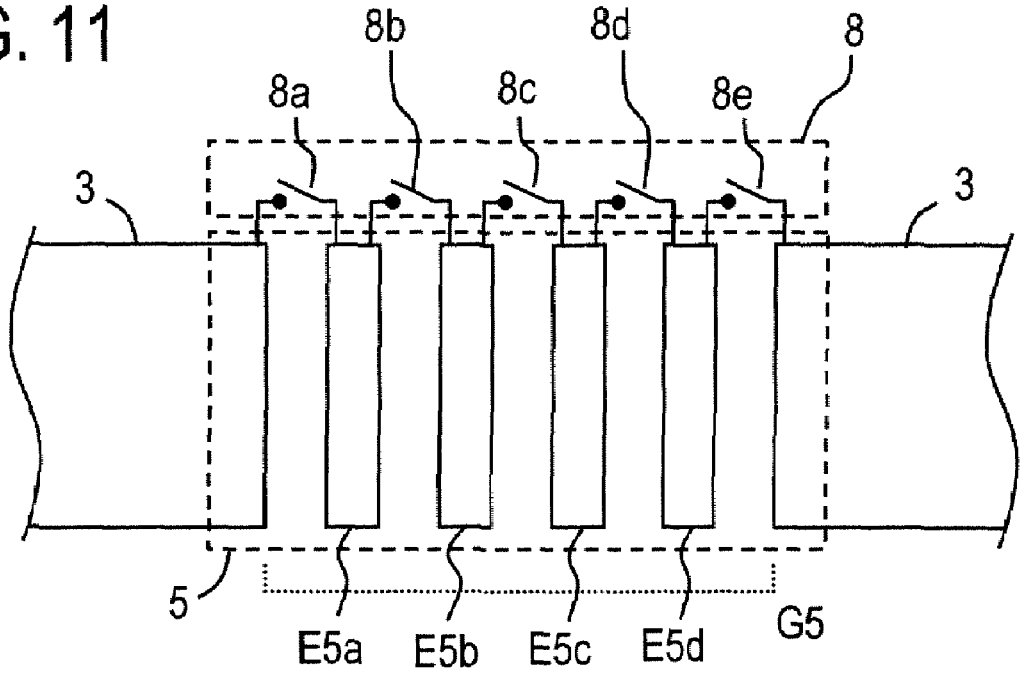
FIG. 11 is a diagram showing a configuration of electrodes of a coupling section according to an embodiment 8.

According to all the embodiments described above, the coupling electrodes are selectively grounded to the ground potential by switch means constituted by shunt switch elements. However, FIG. 11 shows an embodiment 8, in which switch means selectively establishes a short-circuit between an input/output line and a coupling electrode or between coupling electrodes. Four coupling electrodes E5*a*, E5*b*, E5*c* and E5*d* having a length equal to the width of an input/output line 3 are arranged in a gap G5 formed in the input/output line 3 at substantially regular intervals. Switch means 8 is composed of five short-circuiting switch elements, that is, a short-circuiting switch element 8a for short-circuiting one of the opposed ends of the input/output line and the adjacent coupling electrode E5*a*, short-circuiting switch elements 8*b*, 8*c* and 8*d* for short-circuiting adjacent coupling electrodes, and a short-circuiting switch element 8*e* for short-circuiting the other of the opposed ends of the input/output line 3 and the adjacent coupling electrode E5*d*. The size of the gap G5 can be equivalently varied by turning on the short-circuiting switch elements 8*a* and 8*e* and by turning off all the short-circuiting switch elements 8*a* to 8*e*. If the size of the gap G5 is equivalently reduced by selectively turning on the short-circuiting switch elements, the capacitance between the opposed ends of the input/output line 3 increases. As the capacitance increases, the coupling therebetween is enhanced, and the J value increases. In this way, unlike the case of the shunt switch elements, in the case where the short-circuiting switch elements are used, the J value can be increased by simply increasing the number of switch elements that are turned on.

The method of connecting the input/output line 3 and the coupling electrodes to each other or the coupling electrodes to each other by the short-circuiting switch elements can be used regardless of the shape of the coupling electrodes. For example, the coupling electrodes of the interdigital gap structure described above (see FIG. 9) may be connected to each other by short-circuiting switch elements 8*a* to 8*d* as shown by the dashed line in FIG. 9.

Embodiment 9

Figure 12:
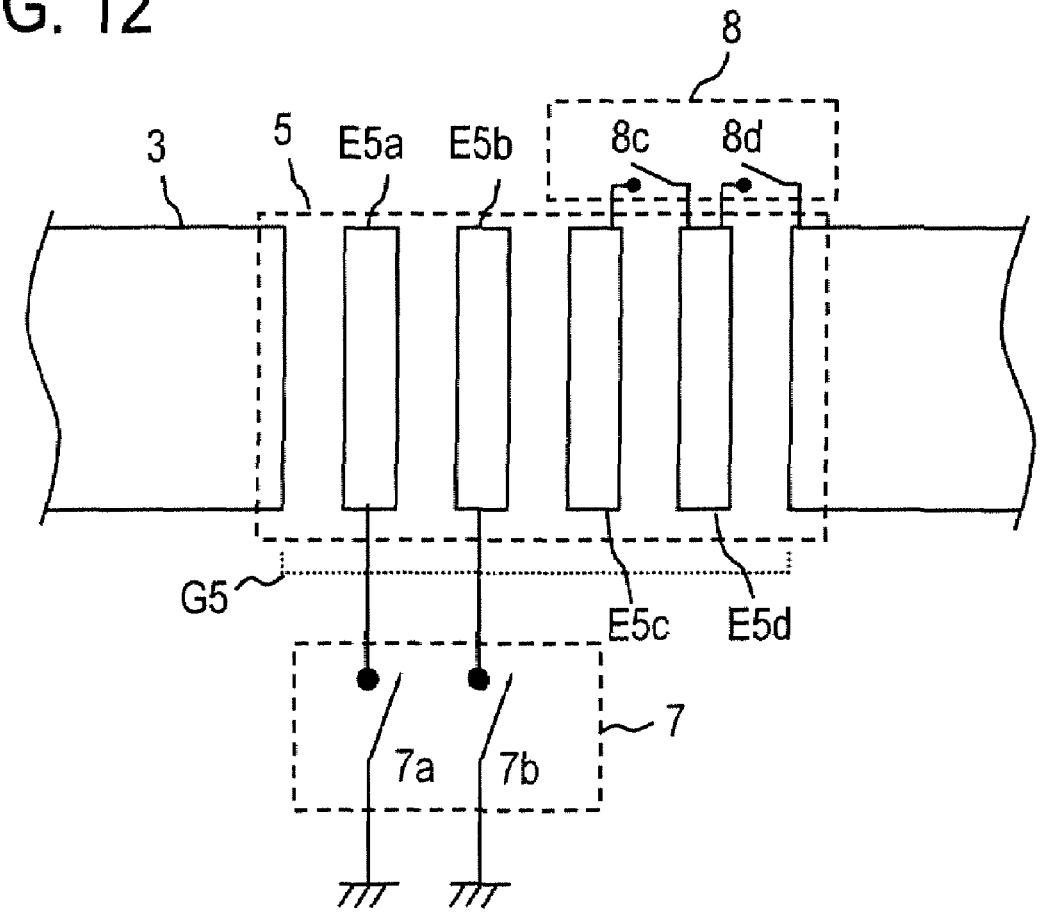
FIG. 12 is a diagram showing a configuration of electrodes of a coupling section according to an embodiment 9.

FIG. 12 shows an embodiment 9, in which some coupling electrodes are controlled by shunt switch elements, and the remaining coupling electrodes are controlled by short-circuiting switch elements, thereby simplifying the control of increase and decrease of the J value. According to the embodiment 9, there are provided switch means 7 comprising shunt switch elements 7*a* and 7*b* for selectively grounding coupling electrodes E5*a* and E5*b* and switch means 8 comprising short-circuiting switch elements 8*c* and 8*d* for cascading coupling electrodes E5*c* and E5*d* to an end of the input/output line 3. If the coupling section is configured in this way, the J value can be increased by turning ON the switch means 8, and the J value can be decreased by turning ON the switch means 7. In this way, the J value can be more easily adjusted to the target value.

Embodiment 10

Figure 13:
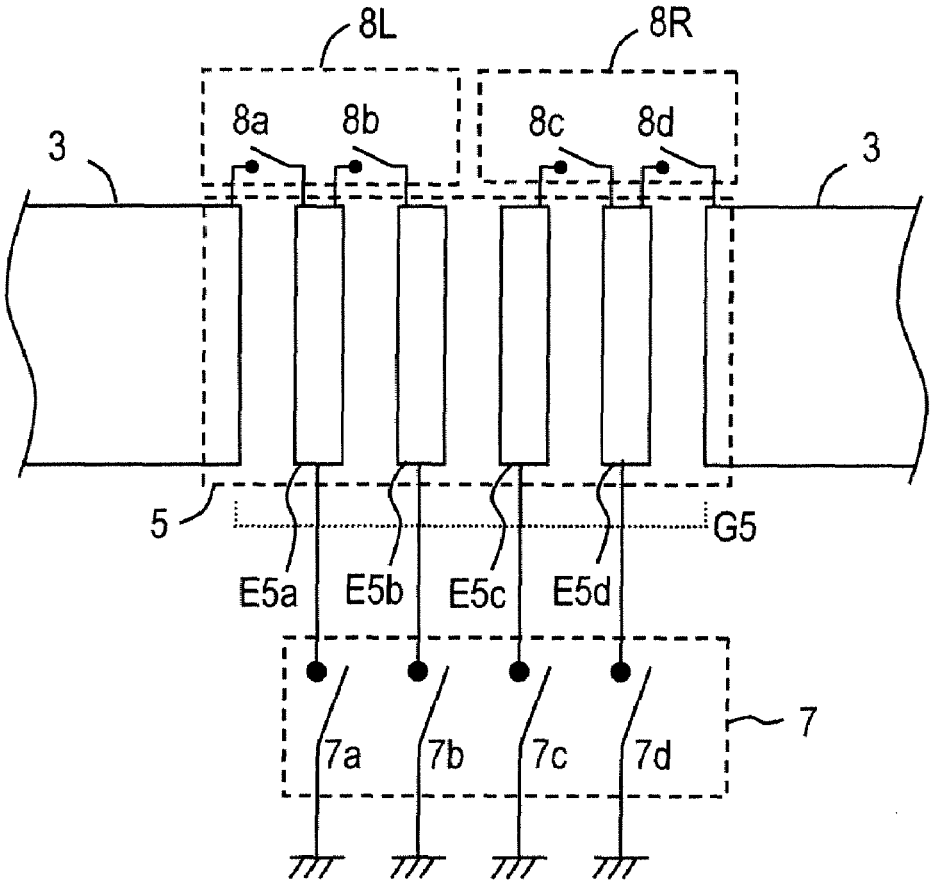
FIG. 13 is a diagram showing a configuration of electrodes of a coupling section according to an embodiment 10.

FIG. 13 shows an embodiment 10, in which the flexibility of the control of the J value by the switch means in the embodiment 9 is enhanced. According to the embodiment 10, there are provided three switch means, that is, switch means 8L comprising short-circuiting switch elements 8*a* and 8*b* for cascading coupling electrodes E5*a* and E5*b* to one of the opposed ends of an input/output line 3, switch means 8R comprising switch elements 8*d* and 8*c* for cascading coupling electrodes E5*d* and E5*c* to the other of the opposed ends of the input/output line 3, and switch means 7 comprising shunt switch elements 7*a*, 7*b*, 7*c* and 7*d* for grounding the coupling electrodes E5*a* to E5*d* at the end opposite to the end thereof connected to the switch means 8L and 8R. If the coupling section and the switch means are configured in this way, in addition to varying the capacitance of a gap G5 by controlling the switch means 8L and 8R, each coupling electrode can be grounded. Therefore, the flexibility of the control of the J value can be increased without changing the number of coupling electrodes. In addition to increasing the control flexibility, the J value can be controlled in two directions as in the embodiment 9. That is, since the capacitance of the gap G5 can be increased by turning ON the switch means 8L and 8R, the J value can be increased. On the other hand, the switch means 7 composed of the shunt switch elements can decrease the J value by increasing the number of grounded electrodes in the gap G5. In this way, the J value can be controlled in the positive direction by turning ON the switch means 8L and 8R, and in the negative direction by turning ON the switch means 7.

Embodiment 11

Figure 14:
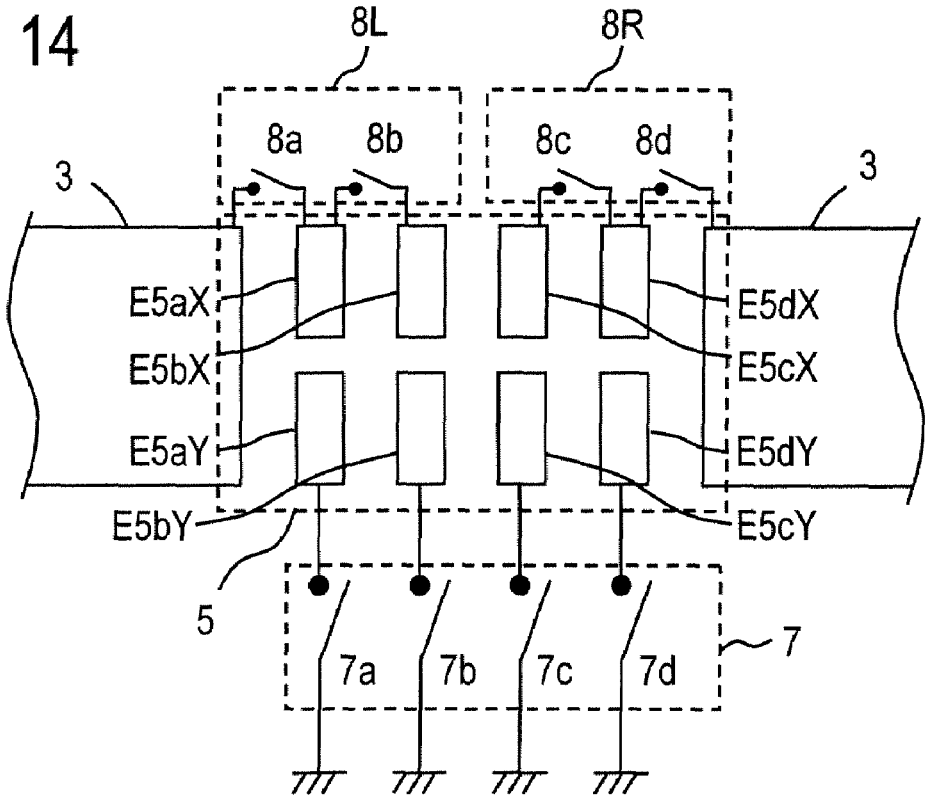
FIG. 14 is a diagram showing a configuration of electrodes of a coupling section according to an embodiment 11.

FIG. 14 shows an embodiment 11, in which the control step size is smaller than that in the embodiment 10. According to the embodiment 11, the coupling electrodes E5*a* to E5*d* are divided into two in the middle of the width of an input/output line 3 to produce eight coupling electrodes E5*a*X, E5*b*X, E5*c*X, E5*d*X, E5*a*Y, E5*b*Y, E5*c*Y and E5*d*Y. In addition, there are provided switch means 8L comprising switch elements 8*a* and 8*b* for cascading the coupling electrodes E5*a*X and E5*b*X to one of the opposed ends of the input/output line 3 and switch means 8R comprising switch elements 8*d* and 8*c* for cascading the coupling electrodes E5*d*X and E5*c*X to the other of the opposed ends of the input/output line 3. In addition, at the ends of the coupling electrodes E5*a*Y to E5*d*Y on the other side of the coupling electrodes E5*a*X to E5*d*X, there is provided switch means 7 comprising shunt switch elements 7*a* to 7*d* for selectively grounding the coupling electrodes E5*a*Y to E5*d*Y. If the coupling section is configured in this way, the flexibility of the control of the J value can be further increased.

Embodiment 12

Figure 15B:
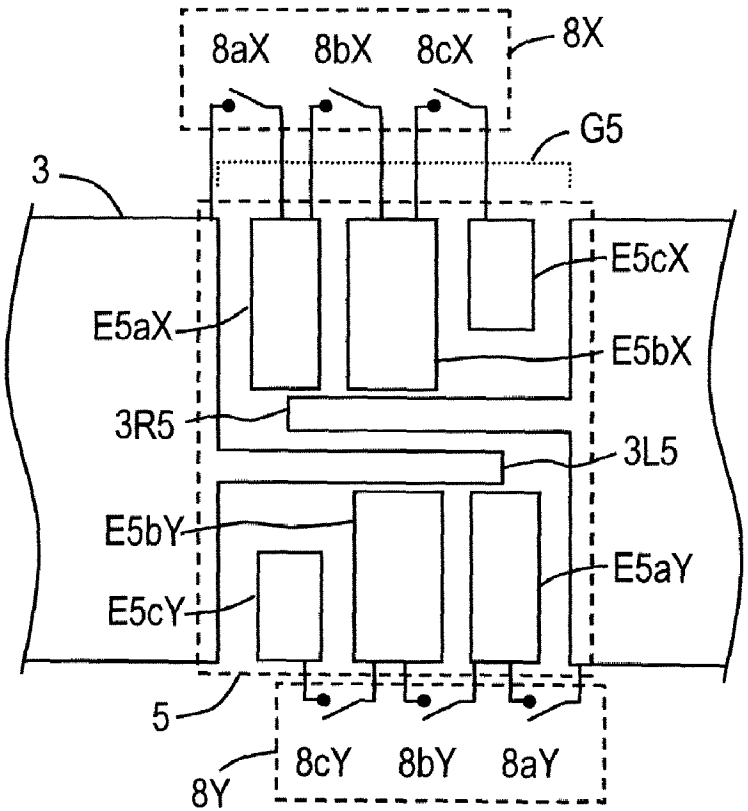
FIG. 15B shows the coupling section according to the embodiment 12 shown in FIG. 15A that is additionally provided with offset coupling sections.
Figure 15A:
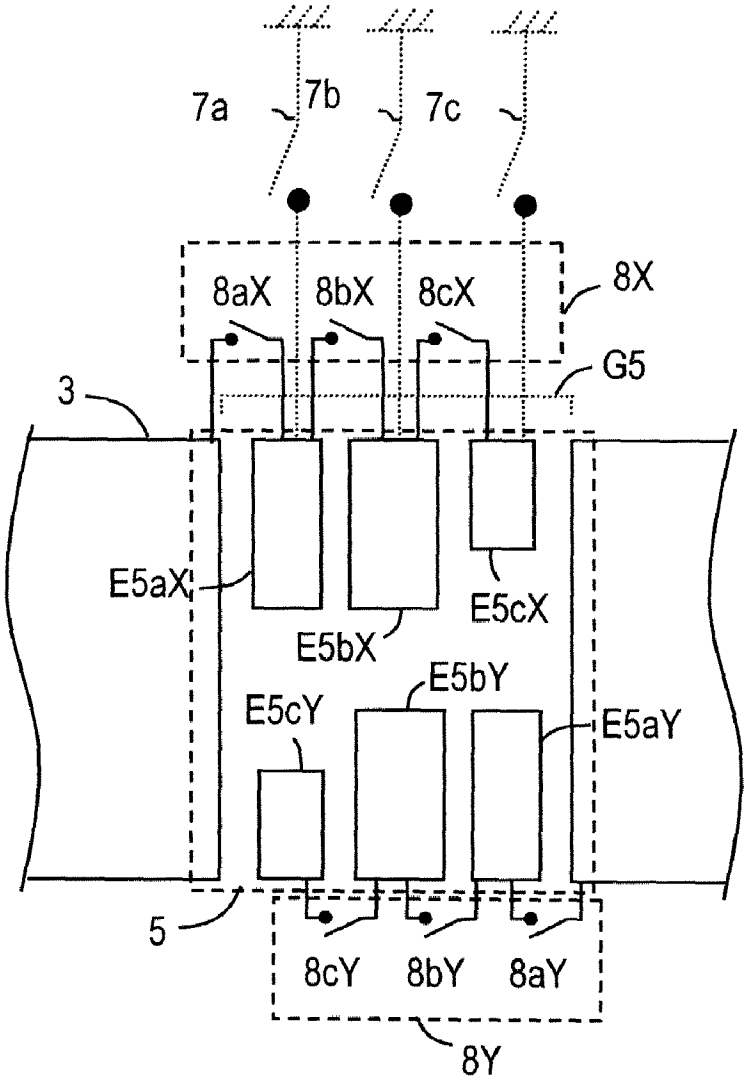
FIG. 15A is a diagram showing a configuration of electrodes of a coupling section according to an embodiment 12.

FIGS. 15A and 15B show an embodiment 12, in which the J value can be easily adjusted to a target value. For easy adjustment of the J value to a target value, the basic configuration of the electrodes of the coupling section is designed to provide a J value as close to the target value as possible, and the J value is then finely adjusted to the target value. The adjustment step size of the J value can be reduced by reducing the area of the coupling electrodes or widening the distance between the coupling electrodes, for example. However, according to an alternative method shown in FIG. 15B, offset coupling sections coupled to a plurality of coupling electrodes are provided in the coupling section. In a gap G5, from one of the opposed ends of an input/output line 3, three coupling electrodes E5*a*X, E5*b*X and E5*c*X having different sizes and cascaded by short-circuiting switch elements 8*a*X, 8*b*X and 8*c*X are arranged in the longitudinal direction of the input/output line 3. From the other of the opposed ends of the input/output line 3, which are opposed to each other via the gap G5, three coupling electrodes E5*a*Y, E5*b*Y and E5*c*Y having different sizes and cascaded to the other of the opposed ends of the input/output line 3 by short-circuiting switch elements 8*a*Y, 8*b*Y and 8*c*Y of switch means 8Y are arranged toward the one of the opposed ends of the input/output line 3. In the gap G5, an offset coupling section 3R5 on the other of the opposed ends of the input/output line 3, which is to be coupled to the coupling electrodes E5*a*X to E5*c*X, extends from the middle of the width of the other of the opposed ends of the input/output line 3 toward the coupling electrode E5*a*X. In addition, an offset coupling section 3L5 on the one of the opposed ends of the input/output line 3, which is to be coupled to the coupling electrodes E5*a*Y to E5*c*Y, extends from the middle of the width of the one end of the input/output line 3 toward the coupling electrode E5*a*Y. FIG. 15A shows a coupling section having the same configuration as that shown in FIG. 15B except that the offset coupling sections 3R5 and 3L5 are eliminated.

Figure 16:
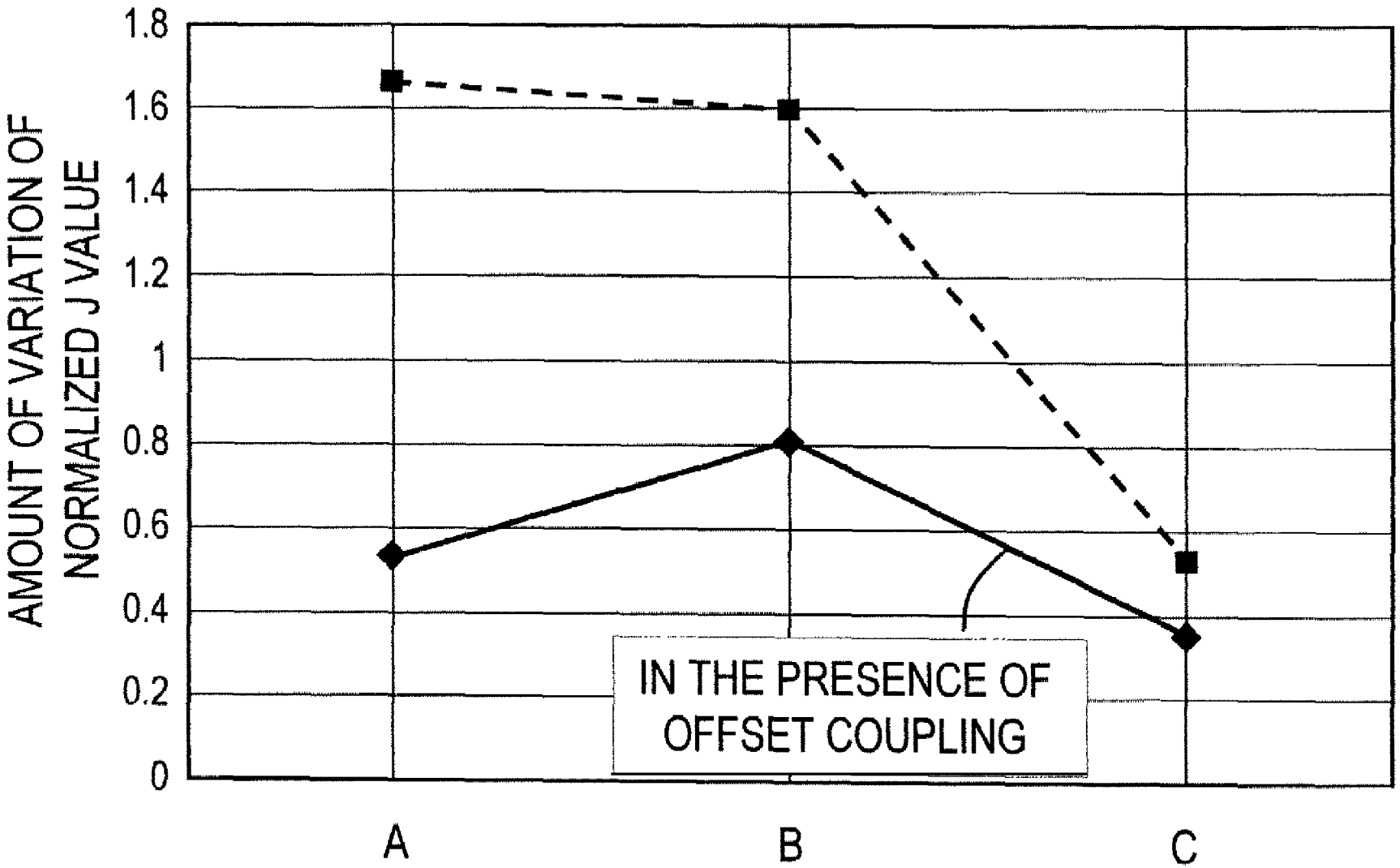
FIG. 16 is a graph showing the result of simulation of the effect of the offset coupling sections in the embodiment 12.

FIG. 16 shows the result of simulation of the effect of the offset coupling sections 3R5 and 3L5 on the amount of variation of the J value. In FIG. 16, the abscissa indicates the ON/OFF state of each short-circuiting switch element, and the ordinate indicates the amount of variation of the J value normalized with a predetermined value. The solid line indicates the amount of variation in the presence of the offset coupling sections 3R5 and 3L5, and the dashed line indicates the amount of variation in the absence of the offset coupling sections 3R5 and 3L5. A character "A" on the abscissa indicates a case where the state of the coupling section changes from a state where all the short-circuiting switch elements of the switch means 8X and 8Y are turned on to a state where two short-circuiting switch elements 8*c*X and 8*c*Y located farthest from their respective connected ends of the input/output line 3, opposed to each other via the gap G5, are turned off. In this case, the amount of variation of the J value in the presence of the offset coupling sections 3R5 and 3L5 is about 0.54, and the amount of variation of the J value in the absence of the offset coupling sections 3R5 and 3L5 is about 1.67. The amount of variation of the J value is smaller when the offset coupling sections 3R5 and 3L5 are provided.

A character "B" on the abscissa indicates a case where the state of the coupling section changes from a state where two short-circuiting switch elements 8*c*X and 8*c*Y located farthest from their respective connected ends of the input/output line 3, opposed to each other via the gap G5, are turned off to a state where the center short-circuiting switch elements 8*b*X and 8*b*Y are additionally turned off. In this case also, the amount of variation of about 0.8 in the presence of the offset coupling sections is smaller than the amount of variation of about 1.59 in the absence of the offset coupling sections.

A character "C" on the abscissa indicates a case where the state of the coupling section changes from the state B to a state where the short-circuiting switch elements 8$a$X and 8$a$Y located closest to their respective connected ends of the input/output line 3, opposed to each other via the gap G5, are additionally turned off, that is, a state where all the short-circuiting switch elements are turned off. In this case also, the amount of variation of about 0.35 in the presence of the offset coupling sections is smaller than the amount of variation of about 0.52 in the absence of the offset coupling sections.

As described above, regardless of the state of the switch elements, the amount of variation of the J value is smaller when the offset coupling sections 3R5 and 3L5 are provided. This is considered to be because the degree of coupling between the offset coupling section 3R5 and the coupling electrodes E5$a$X to E5$c$X and between the offset coupling section 3L5 and the coupling electrodes E5$a$Y to E5$c$Y serves as a bias. Since the offset coupling sections effectively provide a J value as close to the target value as possible, the step size of adjustment by the switch means is reduced, and thus, the tunable filter can easily adjust the J value to the target value.

The short-circuiting switch elements 8$a$X to 8$c$X may be replaced with shunt switch elements 7$a$ to 7$c$ as shown by the dashed line in FIG. 15A. The same holds true for the other short-circuiting switch elements shown in FIGS. 15A and 15B. As described earlier, the amount of control of the J value can be varied by varying the length of the coupling electrodes. Similarly, as shown in FIGS. 15A and 15B, the amount of control of the J value can be varied by varying the width of the coupling electrodes. In that case also, the switch means may be composed of shunt switch elements or short-circuiting switch elements.

Embodiment 13

Figure 17:
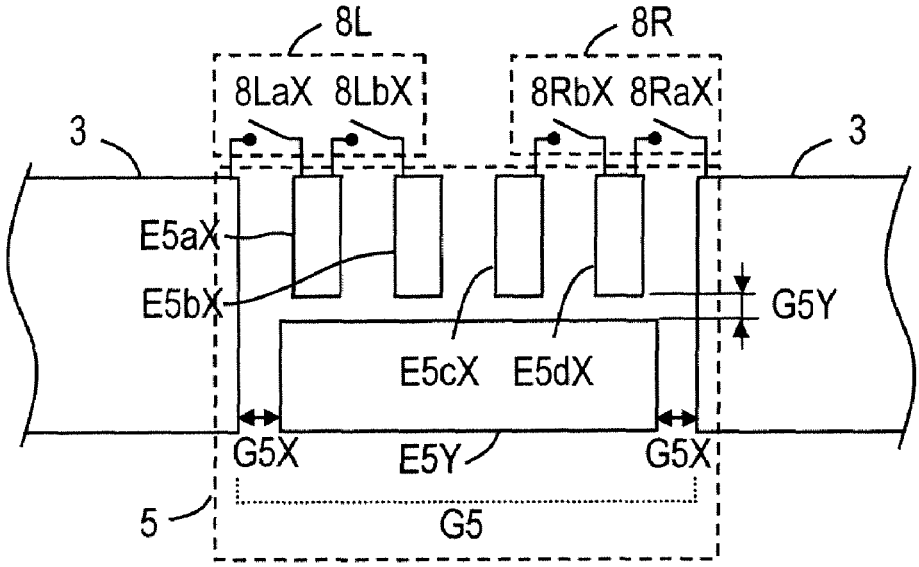
FIG. 17 is a diagram showing a configuration of electrodes of a coupling section according to an embodiment 13.

FIG. 17 shows an embodiment 13, which concerns another example of the offset coupling section. In a gap G5, four coupling electrodes E5$a$X, E5$b$X, E5$c$X and E5$d$X having a length equal to about a half of the width of an input/output line 3 are arranged at regular intervals in the longitudinal direction of the input/output line 3. A short-circuiting switch element 8LaX is provided between one of the ends of the input/output line 3 opposed to each other via the gap G5 and the coupling electrode E5$a$X, a short-circuiting switch element 8LbX is provided between the coupling electrode E5$a$X and the adjacent coupling electrode E5$b$X, and the two short-circuiting switch elements 8LaX and 8LbX constitute switch means 8L. Similarly, the coupling electrodes E5$c$X and E5$d$X are successively cascaded, in this order viewed from the one of the opposed ends of the input/output line 3, to the other of the opposed ends of the input/output line 3 by switch means comprising two short-circuiting switch elements 8RaX and 8RbX. In the gap G5, a rectangular offset coupling electrode E5Y is disposed to face the coupling electrodes E5$a$X to E5$d$X in the width direction of the input/output line 3 with a gap G5Y between the offset coupling electrode E5Y and the coupling electrodes E5$a$X to E5$d$X and gaps G5X between the offset coupling electrode E5Y and the opposed ends of the input/output line 3. The degree of coupling between the offset coupling electrode E5Y and the input/output line 3 and the coupling electrodes E5$a$X to E5$d$X serves as a bias of the J value, and the J value can be varied in small steps using the switch means 8L and 8R.

Embodiment 14

Figure 18:
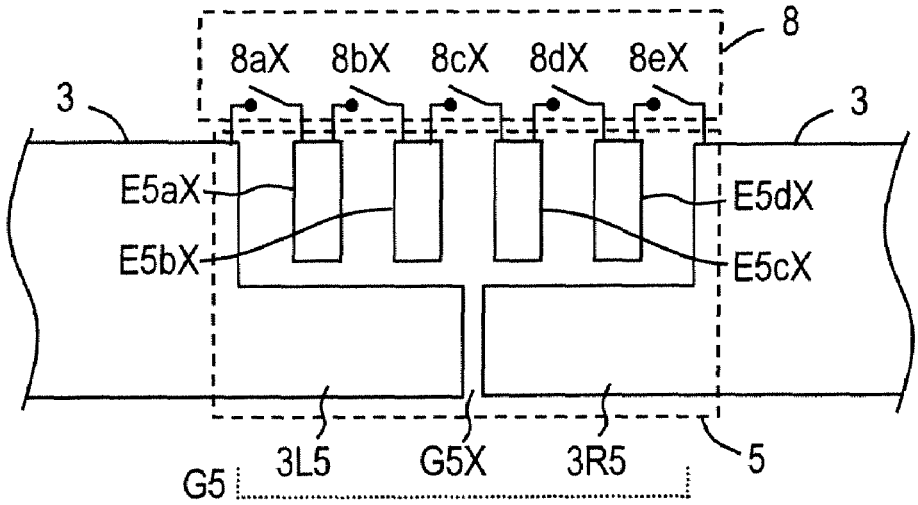
FIG. 18 is a diagram showing a configuration of electrodes of a coupling section according to an embodiment 14.

FIG. 18 shows an embodiment 14, which concerns another example of the offset coupling section. The embodiment 14 differs from the embodiment 13 in the arrangement of the switch means and in the shape of the offset coupling electrode. One of the opposed ends of an input/output line 3 and the other of the opposed ends thereof are opposed to each other via a wide gap G5 over about a half of the width thereof and via a narrow gap G5X over the remaining half of the width thereof. In other words, lateral halves of the input/output line 3 on the opposite sides of the gap extend to reduce the gap to form protrusions 3L5 and 3R5, which are opposed to each other via the narrow gap G5X. In the wide gap G5, four coupling electrodes E5$a$X, E5$b$X, E5$c$X and E5$d$X are arranged at regular intervals in the longitudinal direction of the input/output line 3. A short-circuiting switch element 8$a$X is connected between the one of the opposed ends of the input/output line 3 and the adjacent coupling electrode E5$a$X, a short-circuiting switch element 8$b$X is connected between the coupling electrode E5$a$X and the adjacent coupling electrode E5$b$X, a short-circuiting switch element 8$c$X is connected between the coupling electrode E5$b$X and the adjacent coupling electrode E5$c$X, a short-circuiting switch element 8$d$X is connected between the coupling electrode E5$c$X and the adjacent coupling electrode E5$d$X, and a short-circuiting switch element 8$e$X is connected between the coupling electrode E5$d$X and the other of the opposed ends of the input/output line 3. The short-circuiting switch elements 8$a$X to 8$e$X constitute switch means 8. A rough J value close to the target value can be provided according to the configuration of the protrusions 3L5 and 3R5 disposed close to each other with the narrow gap G5X, and then, the J value can be adjusted finely by operating the switch means 8.

Embodiment 15

Figure 19:
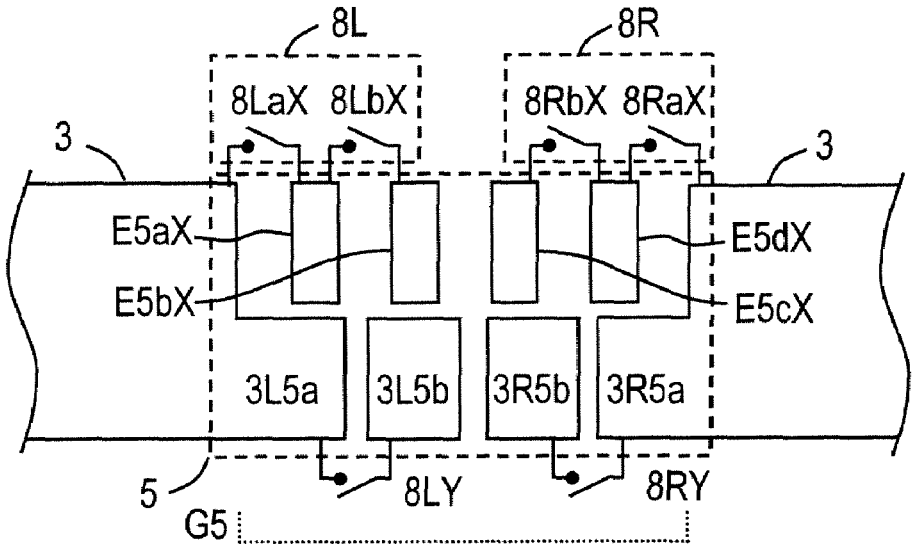
FIG. 19 is a diagram showing a configuration of electrodes of a coupling section according to an embodiment 15.

FIG. 19 shows an embodiment 15, in which the J value is adjusted in two, small and large, adjustment steps. The configuration of the coupling electrodes E5$a$X to E5$d$X and the switch means 8L and 8R according to the embodiment 15 is the same as that according to the embodiment 13 shown in FIG. 17. The protrusions 3L5 and 3R5 in the embodiment 14 shown in FIG. 18 are divided into two in the longitudinal direction of the input/output line 3 to form parts 3L5$a$ and 3L5$b$, and 3R5$a$ and 3R5$b$, respectively. The divisional parts 3L5$a$ and 3L5$b$ of the protrusion 3L5 are connected to each other by a rough adjusting short-circuiting switch 8LY. The divisional parts 3R5$a$ and 3R5$b$ of the protrusion 3R5 are connected to each other by a rough adjusting short-circuiting switch 8RY. The tunable filter configured in this way can adjust the J value in two types of adjustment steps, that is, in a small adjustment step by turning on and off the switch means 8L and 8R and in a large adjustment step by turning on and off the rough adjusting switches 8LY and 8RY.

Embodiment 16

Figure 20:
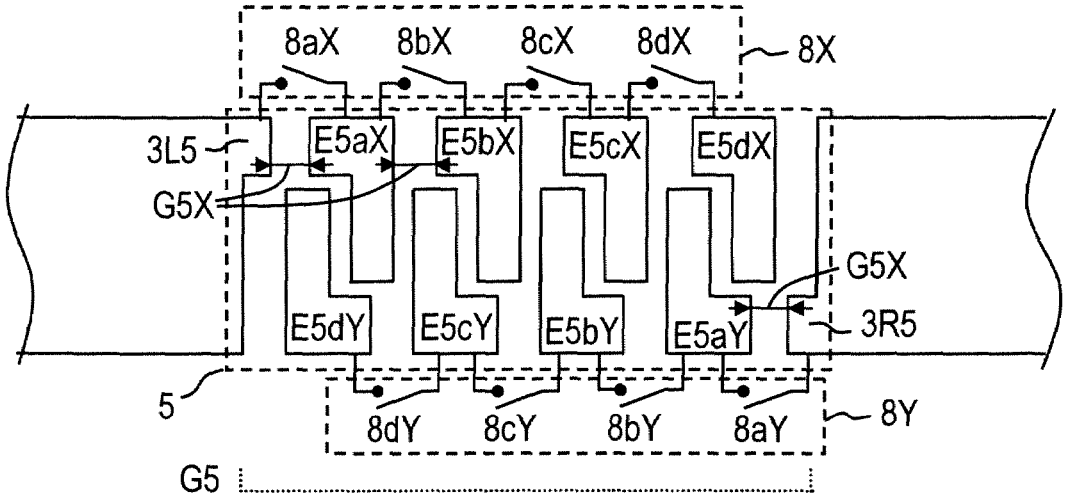
FIG. 20 is a diagram showing a configuration of electrodes of a coupling section according to an embodiment 16.

FIG. 20 shows an embodiment 16, in which the length of the opposed parts of the coupling electrodes is increased to increase the amount of variation of the J value. Four L-shaped coupling electrodes are disposed in a comb arrangement from each of the opposite sides of the gap G5 toward the other side of the gap G5. A part of an input/output line 3 having a predetermined width from one side of the input/output line 3 protrudes from one of the opposed ends of the input/output line 3 facing the gap G5 in the longitudinal direction of the input/output line 3 to form a protrusion 3L5. A coupling electrode E5aX that has the same width as the protrusion 3L5, extends a predetermined length in the longitudinal direction of the input/output line 3 and has a wider part beginning from a point halfway the predetermined length described above is disposed with a gap G5X from the protrusion 3L5. The coupling electrode E5aX has a shape of a letter "L" rotated 180 degrees counterclockwise. Three coupling electrodes having the same shape are arranged in the same orientation in the longitudinal direction of the input/output line 3 with the gap G5X therebetween. One side of the coupling electrode E5dX located farthest from the protrusion 3L5 faces the other of the opposed ends of the input/output line 3. A short-circuiting switch element 8aX is disposed between the protrusion 3L5 and the coupling electrode E5aX, a short-circuiting switch element 8bX is disposed between the coupling electrode E5aX and the adjacent coupling electrode E5bX, a short-circuiting switch element 8cX is disposed between the coupling electrode E5bX and the adjacent coupling electrode E5cX, and a short-circuiting switch element 8dX is disposed between the coupling electrode E5cX and the adjacent coupling electrode E5dX. The four short-circuiting switch elements 8aX to 8dX constitute switch means 8X. In other words, the protrusion 3L5 and the four coupling electrodes E5aX to E5dX are successively cascaded to each other by the short-circuiting switch elements 8aX to 8dX.

A part of the input/output line 3 having a predetermined width from the side of the input/output line 3 opposite to the side with the protrusion 3L5 protrudes from the other of the opposed ends of the input/output line 3 facing the gap G5 in the longitudinal direction of the input/output line 3 to form a protrusion 3R5. A coupling electrode E5aY that has the same width as the protrusion 3R5, extends a predetermined length toward the one end of the input/output line 3 and has a wider part beginning from a point halfway the predetermined length described above is disposed with the gap G5X from the protrusion 3R5. That is, the coupling electrode E5aY has a shape of a letter "L". Three coupling electrodes having the same shape are arranged in the same orientation toward the one end of the input/output line 3 with the gap G5X therebetween. That is, the coupling electrodes E5dY to E5aY are disposed to mesh with the coupling electrodes E5aX to E5dX, respectively. One side of the coupling electrode E5dY located farthest from the protrusion 3R5 faces the one end of the input/output line 3. The protrusion 3R5 and the coupling electrodes E5aY to E5dY are cascaded to each other by four short-circuiting switch elements 8aY to 8dY. If the coupling section is configured in this way, the length of the opposed parts of the electrodes is increased, and therefore the amount of variation of the J value is increased.

Embodiment 17

Figure 21:
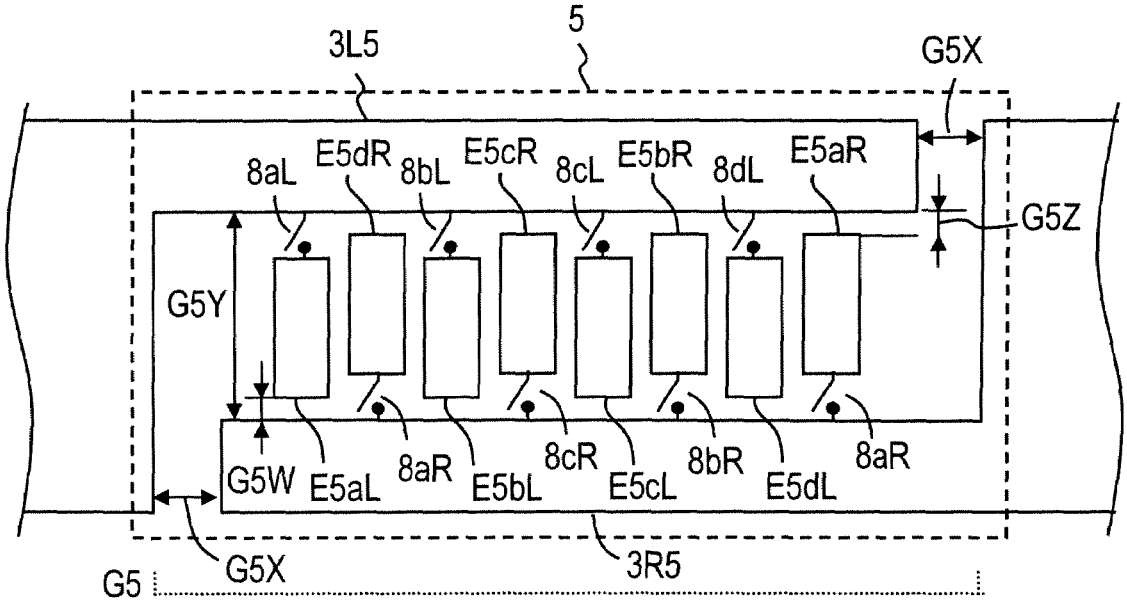
FIG. 21 is a diagram showing a configuration of electrodes of a coupling section according to an embodiment 17.

FIG. 21 shows a coupling section according to another embodiment 17. A part of an input/output line 3 having a predetermined width from one side of the input/output line 3 protrudes from one of the opposed ends of the input/output line 3 facing the gap G5 in the longitudinal direction of the input/output line 3 to form a protrusion 3L5 that faces the other of the opposed ends of the input/output line 3 with a gap G5X therebetween. A part of the input/output line 3 having a predetermined width from the side of the input/output line 3 opposite to the side with the protrusion 3L5 protrudes from the other of the opposed ends of the input/output line 3 facing the gap G5 toward the one end of the input/output line 3 to form a protrusion 3R5 that faces the one end of the input/output line 3 with the gap G5X therebetween. That is, in the gap G5, the protrusions 3L5 and 3R5 face each other with a gap G5Y therebetween in the width direction of the input/output line 3. In the gap G5Y, a coupling electrode E5aL that is connected to the protrusion 3L5 by a short-circuiting switch element 8aL at one end and faces the protrusion 3R5 with a gap G5W at the other end is disposed, and a coupling electrode E5dR that is connected to the protrusion 3R5 by a short-circuiting switch element 8aR at one end and faces the protrusion 3L5 with a gap G5Z at the other end is disposed adjacent to the coupling electrode E5aL in the longitudinal direction of the input/output line 3. A coupling electrode E5bL having the same structure as the coupling electrode E5aL that is connected to the protrusion 3L5 by a short-circuiting switch element 8bL at one end is disposed adjacent to the coupling electrode E5dR, and so on. That is, four coupling electrodes E5aL, E5bL, E5cL and E5dL connected to the protrusion 3L5 by short-circuiting switch elements 8aL, 8bL, 8cL and 8dL, respectively, and four coupling electrodes E5dR, E5cR, E5bR and E5aR connected to the protrusion 3R5 by short-circuiting switch elements 8dR, 8cR, 8bR and 8aR, respectively, are alternately arranged in the longitudinal direction of the input/output line 3. Since the coupling electrodes E5aL to E5dL and the coupling electrodes E5aR to E5dR are connected in parallel to the protrusions 3L5 and 3R5, respectively, the adjustment step size of the J value can be increased, and the range of variation thereof can be increased.

Embodiment 18

Figure 22A:
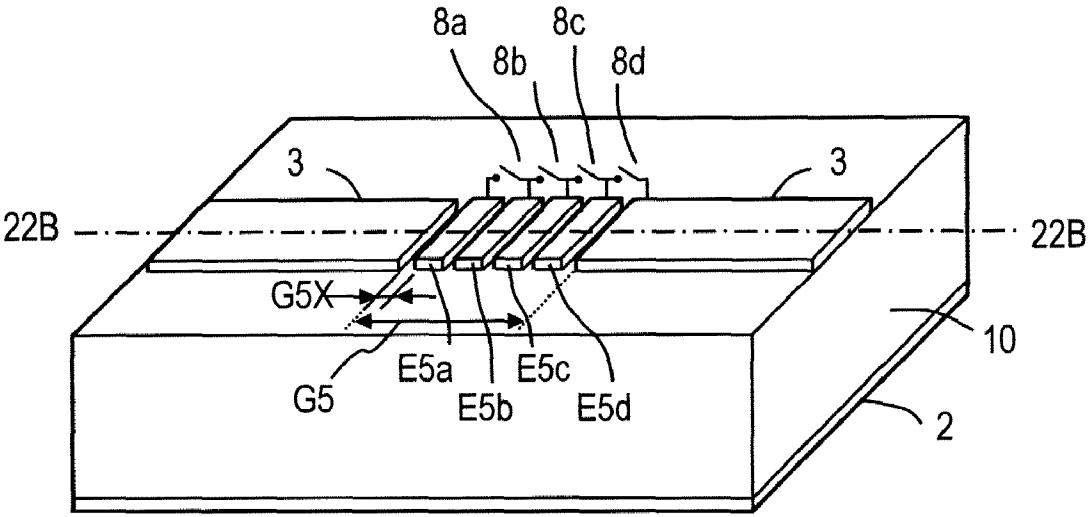
FIG. 22A is a perspective view of a coupling section having a three-dimensional structure according to an embodiment 18.
Figure 22B:
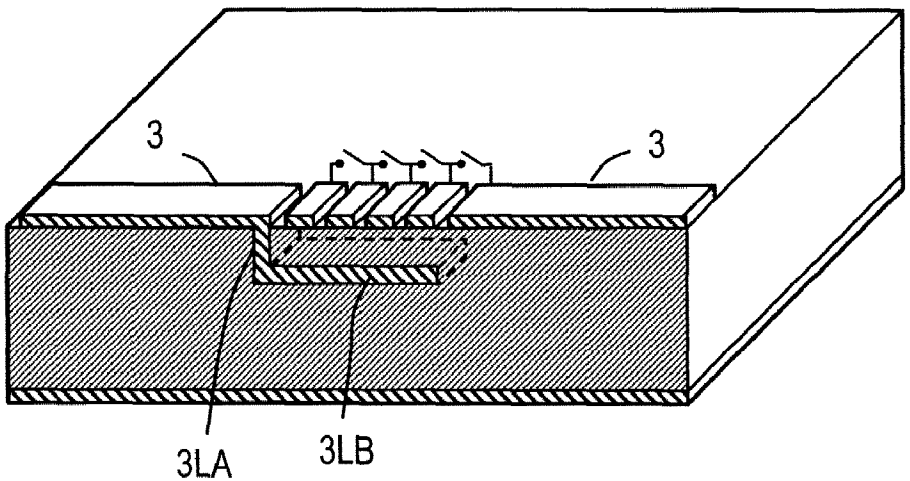
FIG. 22B is a cross-sectional view taken along the line 22B-22B in FIG. 22A.

FIG. 22A is a perspective view of a coupling section having a three-dimensional structure according to an embodiment 18, and FIG. 22B is a cross-sectional view taken along the line 22B-22B in FIG. 22A. The coupling section of the three-dimensional structure has an offset coupling section 3LB that is embedded in a dielectric substrate 10 at a distance from the surface thereof on which an input/output line is formed, is connected at one end to the input/output line via a connecting conductor 3LA, and faces and is coupled to at least one of the coupling electrodes E5a to E5d. According to the embodiment 18 shown in FIGS. 22A and 22B, four coupling electrodes E5a, E5b, E5c and E5d having the same width as the line width of the input/output line 3 and a predetermined length are arranged in a gap G5 in the longitudinal direction of the input/output line 3 with a gap G5X therebetween. The four coupling electrodes E5d to E5a are successively cascaded at one end thereof to one of the opposed ends of the input/output line 3 by four short-circuiting switch elements 8d to 8a, respectively. The connecting conductor 3LA extends from the other of the opposed ends of the input/output line 3 facing the gap G5 perpendicularly to the input/output line 3 in the thickness direction of the dielectric substrate 10, and the offset coupling section 3LB extends from the end of the connecting conductor 3LA opposite to the end connected to the input/output line 3 to face the coupling electrodes E5a to E5d. If the coupling section has such a three-dimensional structure, the amount of coupling can be increased compared with the two-dimensional structure without varying the size of the coupling electrodes E5a to E5d, and thus, the J value can be varied more widely. Such a three-dimensional structure can be easily fabricated by application of the micromachining art as described above. While the offset coupling section faces all of the four coupling electrodes E5a to E5d in the embodiment shown in FIG. 22, the present invention is not limited thereto, and the offset coupling section may face one, two or three of the coupling electrodes. The present invention, including the number of coupling electrodes, is not limited to the embodiment 18 shown in FIG. 22.

Embodiment 19

Figure 23:
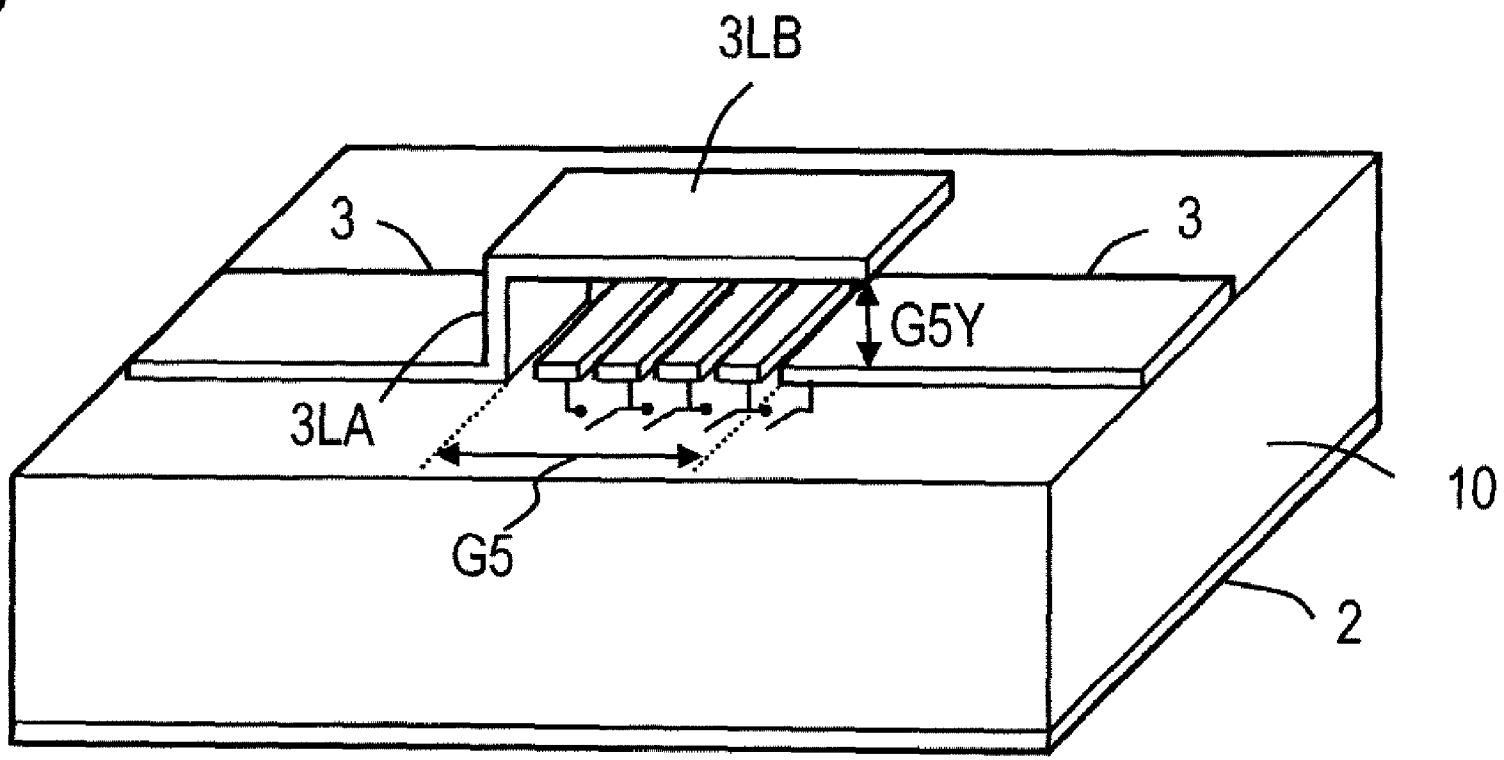
FIG. 23 is a perspective view of a coupling section having a three-dimensional structure according to an embodiment 19.

FIG. 23 shows a coupling section having a three-dimensional structure according to another embodiment 19. According to this embodiment, the offset coupling section 3LB is disposed outside the dielectric substrate 10 at a distance from the surface of the substrate, unlike the embodiment shown in FIGS. 22A and 22B in which the offset coupling section 3LB is provided in the dielectric substrate 10. That is, in the embodiment shown in FIG. 23, the connecting conductor 3LA is formed on the dielectric substrate 10 to stand upright from one of the opposed ends of an input/output line 3 facing a gap G5, and the offset coupling section 3LB extends from the tip of the connecting conductor 3LA to face coupling electrodes E5*a* to E5*d* with a gap G5Y from the coupling electrodes. Such a coupling section in which the offset coupling section 3LB is disposed above the surface of the dielectric substrate 10 to face the coupling electrodes with the gap G5Y can provide a greater J value than the coupling section having the two-dimensional structure. While the offset coupling section faces all of the four coupling electrodes E5*a* to E5*d* in the embodiment shown in FIG. 23, the present invention is not limited thereto as described above.

Embodiment 20

Figure 24A:
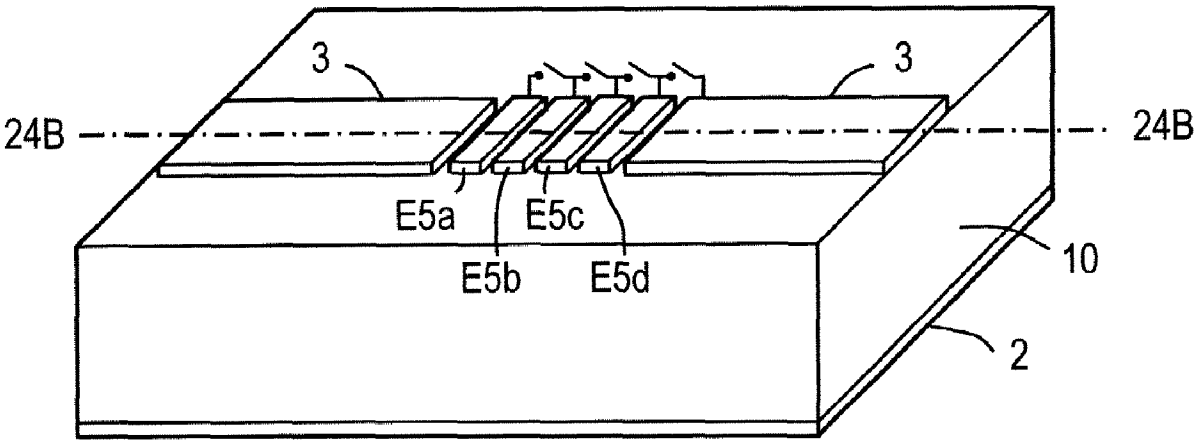
FIG. 24A is a perspective view of a coupling section having a three-dimensional structure according to an embodiment 20.
Figure 24B:
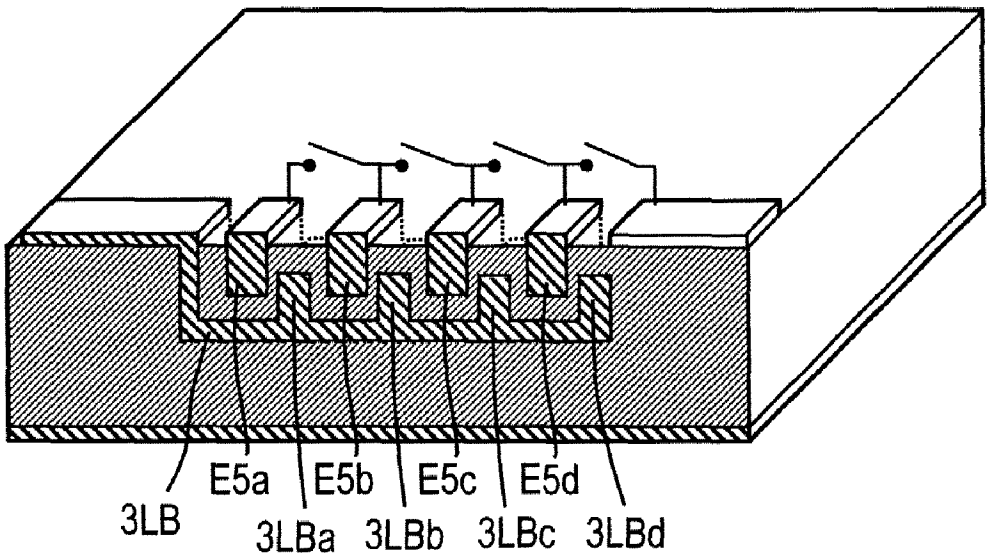
FIG. 24B is a cross-sectional view taken along the line 24B-24B in FIG. 24A.

FIG. 24A is a perspective view of a coupling section having a three-dimensional structure according to another embodiment 20. The coupling section according to the embodiment 20 shown in FIG. 24A has exactly the same planar configuration as the coupling section according to the embodiment 18 shown in FIG. 22. FIG. 24B is a cross-sectional view taken along the line 24B-24B in FIG. 24A. The coupling section of the three-dimensional structure has coupling electrodes extending perpendicularly into a dielectric substrate and an offset coupling section having coupling protrusions coupled to the coupling electrodes alternately. According to the embodiment shown in FIG. 24, coupling electrodes E5*a* to E5*d* extend perpendicularly into the dielectric substrate 10. The offset coupling section 3LB facing the coupling electrodes in the dielectric substrate 10 has a coupling protrusion 3LBa extending between the coupling electrodes E5*a* and E5*b*. The offset coupling section 3LB has a coupling protrusion 3LBb extending between the coupling electrodes E5*b* and E5*c*, a coupling protrusion 3LBc extending between the coupling electrodes E5*c* and E5*d*, and a coupling protrusion 3LBd extending between the coupling electrode E5*d* and one of the opposed ends of the input/output line 3. The coupling electrodes E5*a* to E5*d* and the coupling protrusions 3LBa to 3LBd are disposed to sandwich the material of the dielectric substrate 10 just like two gears meshing with each other. If the coupling section is configured in this way, the amount of coupling increases, and the J value can be varied greatly. While the coupling electrodes are disposed in the dielectric substrate 10 in the embodiment shown in FIG. 24, the coupling electrodes may protrude out from the surface of the dielectric substrate 10. Furthermore, an offset coupling section may be provided to face the protruding coupling electrodes as shown in FIG. 23, and furthermore, the offset coupling section may have coupling protrusions.

Embodiment 21

Figure 25:
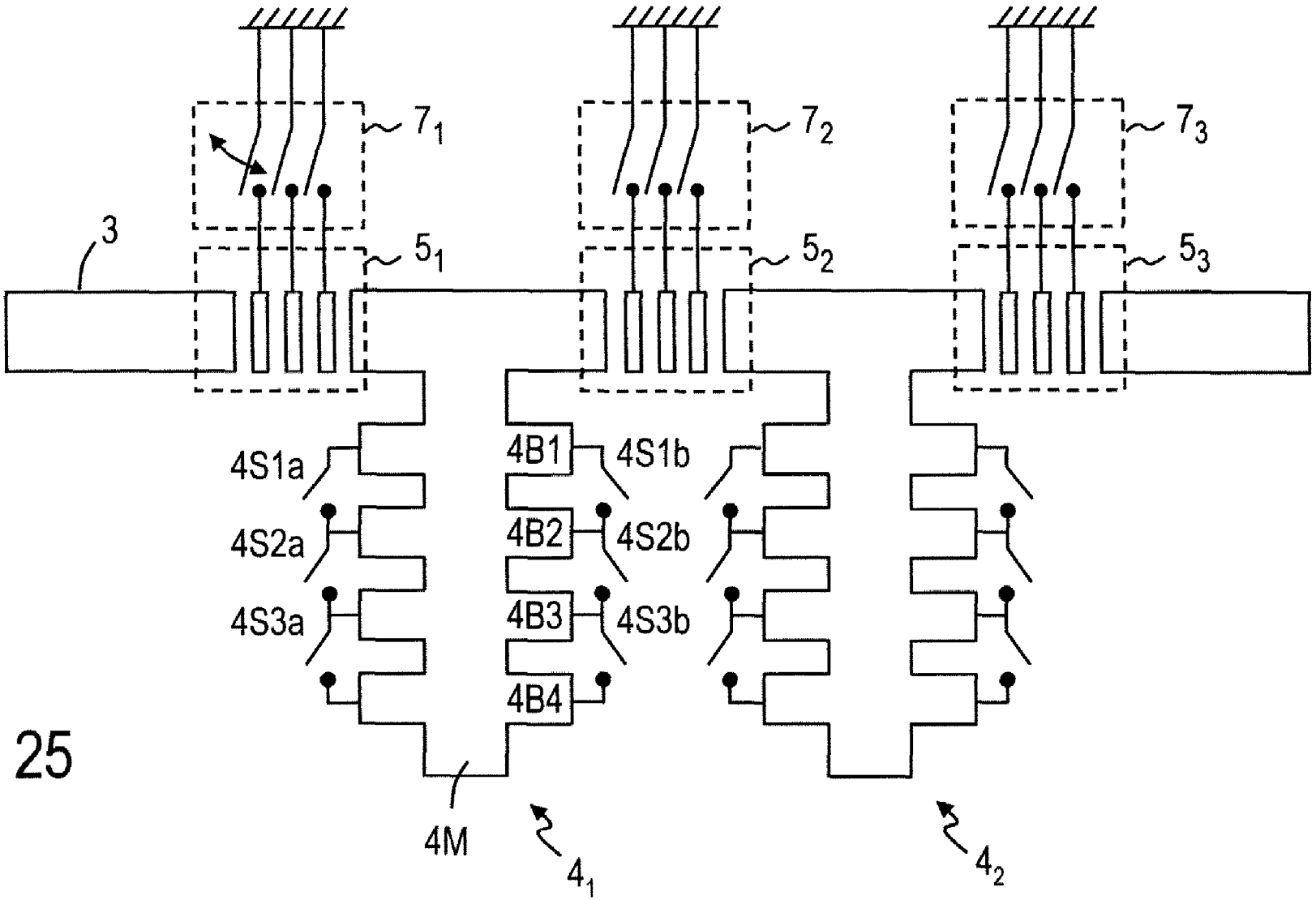
FIG. 25 shows a tunable resonator capable of finely controlling the resonance frequency according to an embodiment 21.

Modifications of the electrode arrangement of the coupling section have been described above. Now, FIG. 25 shows a tunable filter capable of finely controlling the resonance frequency according to an embodiment 21, and an operation of the tunable filter will be described below. FIG. 25 shows a tunable filter that has basically the same configuration as that shown in FIG. 1 and described above and differs therefrom only in the configuration of the tunable resonator. The tunable resonator $\mathbf{4}_1$ shown in FIG. 25 comprises a resonant line 4M having a predetermined length connected to the input/output line 3, a plurality of (four in the embodiment shown in FIG. 25) wider parts 4B1, 4B2, 4B3 and 4B4 having a greater width and arranged along the length of the resonant line 4M at predetermined intervals, and switch elements 4S1*a*, 4S1*b*, 4S2*a*, 4S2*b*, 4S3*a* and 4S3*b* for short-circuiting the ends of adjacent wider parts on both sides. The tunable resonator $\mathbf{4}_2$ disposed adjacent to the tunable resonator $\mathbf{4}_1$ via the coupling section $\mathbf{5}_2$ has exactly the same configuration as the tunable resonator $\mathbf{4}_1$. The tunable resonator $\mathbf{4}_1$ utilizes the skin effect of high-frequency signals propagating through a conductor. The higher the frequency, the more power of an electric signal transmitted through a line are concentrated to the outer periphery of the line. This is because the skin effect of high-frequency signals, and the penetration depth of electric signals propagating through a conductor in the width direction of the conductor is expressed by the following equation (5)

$$SkinDepth = \frac{1}{\sqrt{\pi f \sigma \mu}} \tag{5}$$

In this equation, a character "f" denotes the frequency, a character "σ" denotes the conductivity of the conductor, and a character "μ" denotes the permeability of the conductor. High-frequency currents do not penetrate into the line beyond the skin-depth and flow through the outer periphery thereof. Therefore, if the line of the resonator is shaped as shown in FIG. 25, and the switch elements are provided on the opposite ends of the wider parts, the equivalent line length of the resonator can be varied by turning on and off the switch elements. Specifically, if all the switch elements 4S1*a*, 4S1*b* to 4S3*a*, 4S3*b* are turned off, the resonator has an equivalent line length approximately equal to the length of the outer periphery of the line constituted by the resonant line 4M and the wider parts 4B1 to 4B4. In this state, if the switch elements 4S1*a* and 4S1*b* are turned on, the resonator has a reduced equivalent line length approximately equal to the line length described above minus the length of the outer periphery of one wider part. In this way, the resonance frequency can be varied with high reproducibility depending on the state of the switch elements.

As described above, if a tunable resonator taking advantage of the skin effect and the coupling sections are combined, there can be provided a tunable filter that can finely control the bandwidth and the center frequency with high reproducibility.

APPLICATION EXAMPLE

Figure 26:
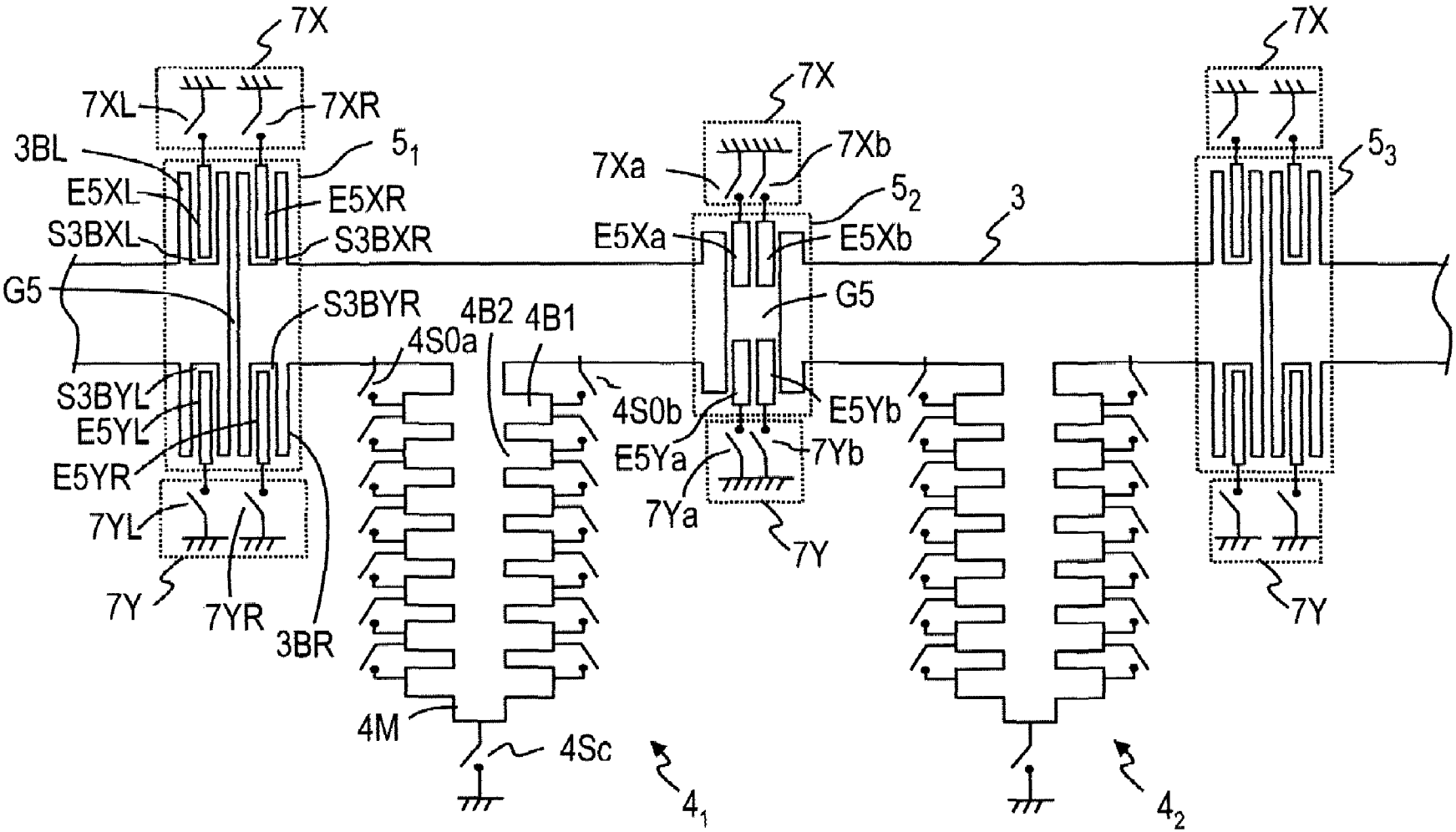
FIG. 26 shows a 5-GHz-band 2-pole band-pass tunable filter according to the present invention.

A 5-GHz-band 2-pole band-pass tunable filter according to the present invention is designed based on the configuration according to the embodiment 21 (shown in FIG. 25). FIG. 26 shows the configuration of the tunable filter. A coupling section $\mathbf{5}_1$ has a gap G5, wider parts 3BL and 3BR of the input/output line 3 formed on the opposite sides of the gap G5 by expanding the input/output line 3 in the width direction thereof, and slits S3BXL and S3BYL, and S3BXR and S3BYR formed in the wider parts 3BL and 3BR, respectively, and extending from the outer ends of the wider parts toward the center of the input/output line 3. Coupling electrodes E5XL, E5YL, E5XR and E5YR are disposed in the slits along the length of the slits and grounded at the ends opposite from the center line of the input/output line 3 by shunt switch elements 7XL, 7YL, 7XR and 7YR, respectively. The switch elements 7XL and 7XR constitute switch means 7X, and the switch elements 7YL and 7YR constitute switch means 7Y.

Similarly, in a coupling section $\mathbf{5}_2$, the input/output part 3 has wider parts on the opposite sides of a gap G5. In the gap G5, two coupling electrodes E5Xa and E5Ya are arranged at a predetermined distance in the width direction of the input/output line 3, and two coupling electrodes E5Xb and E5Yb are arranged at a distance from the coupling electrodes E5Xa and E5Ya in the longitudinal direction of the input/output line 3 and in parallel therewith. The coupling electrodes E5Xa and E5Xb are grounded at the ends opposite to the ends close to the center line of the input/output line 3 by shunt switch elements 7Xa and 7Xb. Similarly, the coupling electrodes E5Ya and E5Yb are grounded at the ends opposite from the center line of the input/output line 3 by shunt switch elements 7Ya and 7Yb. The switch elements 7Xa and 7Xb constitute switch means 7X, and the switch elements 7Ya and 7Yb constitute switch means 7Y A coupling section $\mathbf{5}_3$ has exactly the same configuration as the coupling section $\mathbf{5}_1$.

The tunable resonator $\mathbf{4}_1$ shown in FIG. 26 differs from the tunable resonator $\mathbf{4}_1$ shown in FIG. 25 in the points described below. In FIG. 26, the tip of the resonant line 4M, that is, the end of the resonant line 4M opposite to the end connected to the input/output line 3 can be grounded by a shunt switch element 4Sc. In other words, the tunable resonator can be switched between the state where the tip of the resonant line 4M is opened and in the state where the tip of the resonant line 4M is short-circuited. In addition, in FIG. 26, the number of wider parts 4B1, 4B2, . . . is greater than that in FIG. 25, and short-circuiting switches 4S0*a* and 4S0*b* are provided between the opposite ends of the wider part 4B1 closest to the input/output line 3 and the input/output line 3. In this way, a short-circuiting switch may be provided between the input/output line 3 and a wider part. This can increase the number of choices of line lengths of the resonator.

Figure 27:
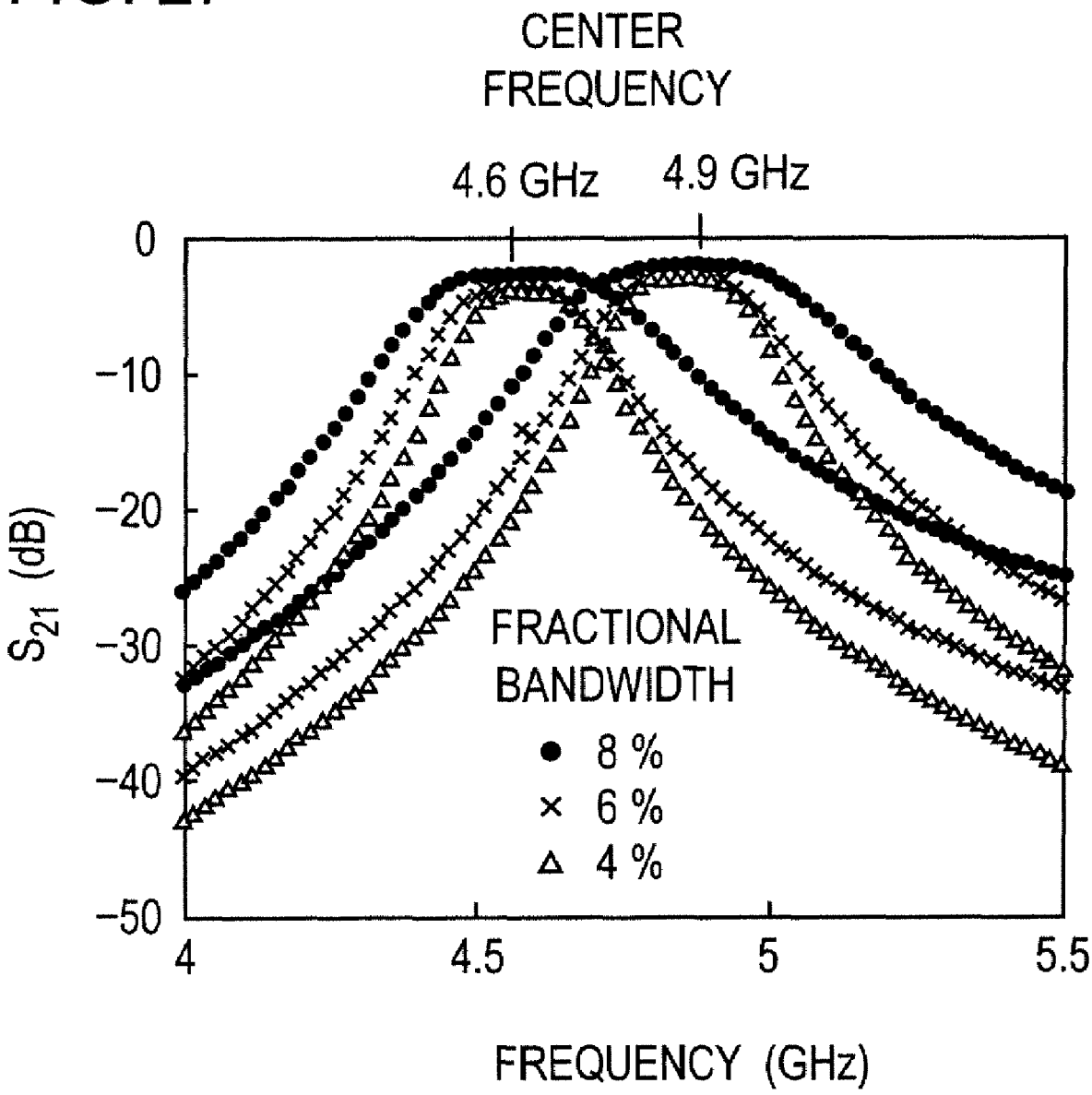
FIG. 27 is a graph showing the frequency characteristics of the tunable filter shown in FIG. 26 determined by electromagnetic field simulation.

FIG. 27 shows the result of electromagnetic field simulation of the frequency characteristics of the tunable filter configured as described above. The simulation is conducted under the conditions that the dielectric substrate 10 is made of alumina (having a dielectric constant of 9.5), and the line is made of gold. In FIG. 27 showing the frequency characteristics, the abscissa indicates the frequency (GHz), and the ordinate indicates the S parameter $S_{21}$ (dB).

The block dots in FIG. 27 show the characteristics in the case where all the shunt switch elements for grounding the coupling electrodes of the coupling sections $\mathbf{5}_1$, $\mathbf{5}_2$ and $\mathbf{5}_3$ are turned off. In this case, the fractional bandwidth is about 8%. The fractional bandwidth remains 8% even if the line length of the tunable resonators $\mathbf{4}_1$ and $\mathbf{4}_2$ is varied to vary the center frequency from 4.6 GHz to 4.9 GHz in the state where all the shunt switch elements are turned off.

The crosses show the characteristics in the case where the four coupling electrodes of each of the coupling sections $\mathbf{5}_1$, $\mathbf{5}_2$ and $\mathbf{5}_3$ are grounded diagonally. In this case, the fractional bandwidth is about 6%. The triangles show the characteristics in the case where all the shunt switch elements for grounding the coupling electrodes of the coupling sections $\mathbf{5}_1$, $\mathbf{5}_2$ and $\mathbf{5}_3$ are turned on. In this case, the fractional bandwidth is about 4%. When reducing the fractional bandwidth from 6% to 4%, the line length of the tunable resonators $\mathbf{4}_1$ and $\mathbf{4}_2$ is adjusted by turning on or off the switch elements on the opposite ends of the wider parts, in order to maintain the center frequency. Of course, if different center frequencies of 4.6 GHz and 4.9 GHz occur for the same bandwidth, that is a result of adjustment of the line length of the tunable resonators $\mathbf{4}_1$ and $\mathbf{4}_2$.

As described above, the tunable filter according to the present 25 invention can control the center frequency and the bandwidth separately.

Figure 28:
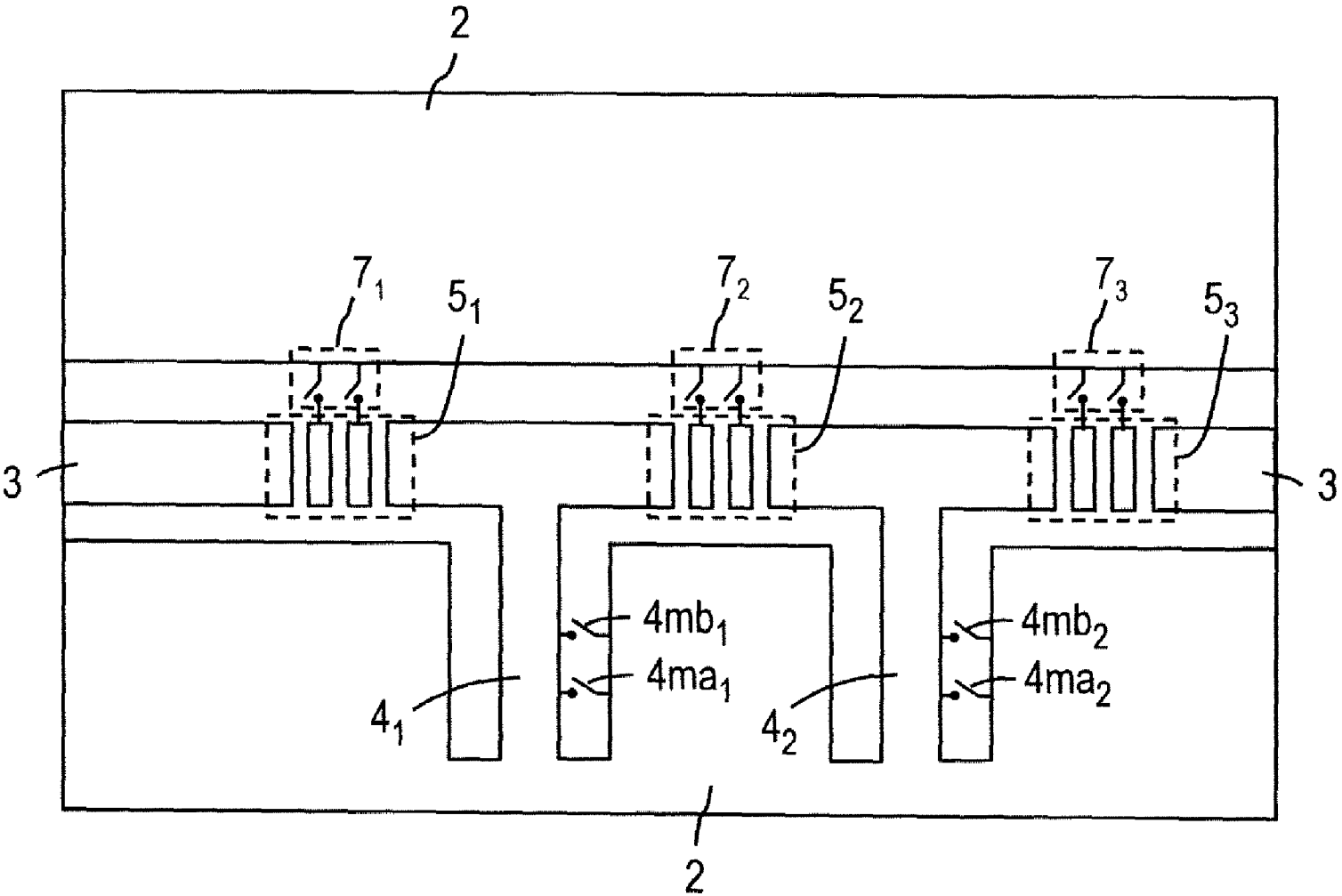
FIG. 28 shows a tunable filter according to the embodiment 1 implemented as coplanar line configuration.

While the microstrip line composed of the grounding conductor 2 mounted on the back surface of the dielectric substrate 10 has been described with regard to all the above embodiments, the present invention can be equally applied to other various line configurations. For example, a tunable filter according to the present invention can be implemented as a coplanar waveguide configuration in which an input/output line 3 and a grounding conductor 2 are formed on the same surface of a dielectric substrate 10, as shown in FIG. 28. The configuration shown in FIG. 28 is exactly the same as that according to the embodiment 1 shown in FIG. 4A and described above except that it is implemented as a coplanar waveguide configuration. Therefore, the same components are denoted by the same reference numerals, and further description thereof will be omitted.

Figure 29:
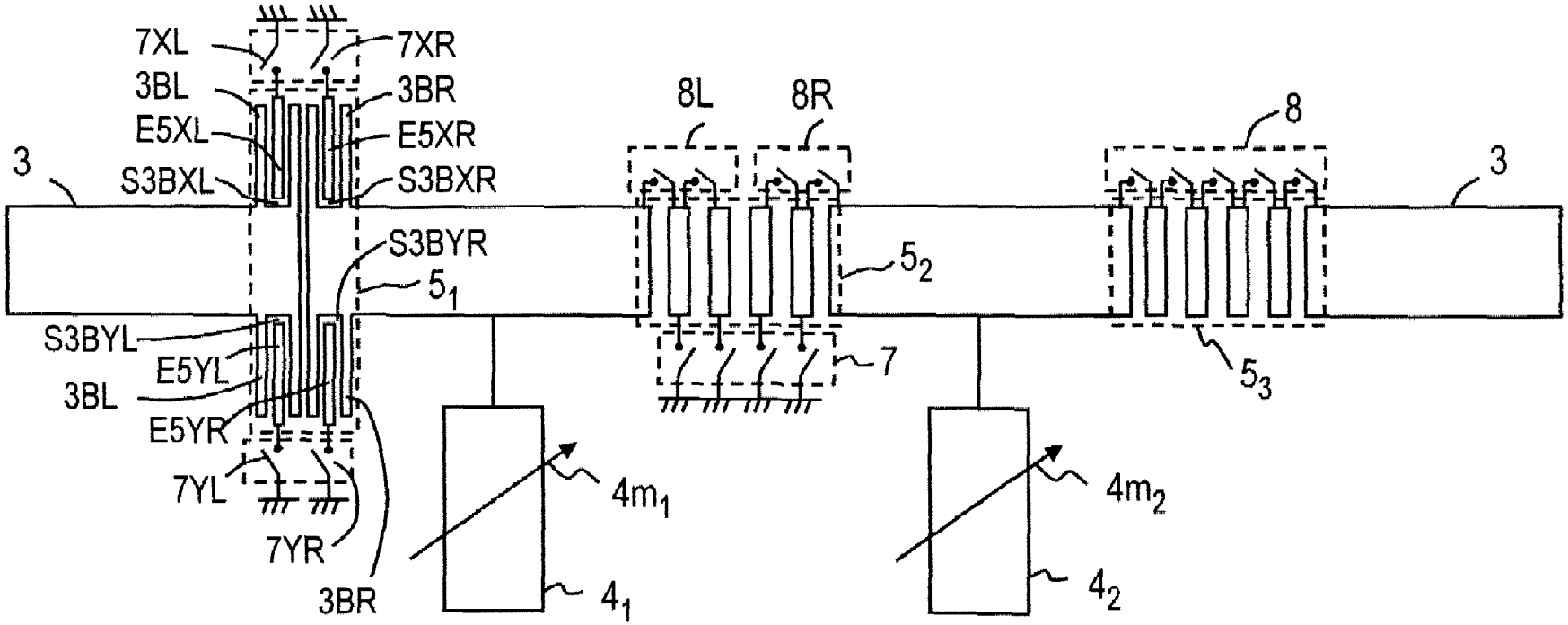
FIG. 29 is a diagram for demonstrating that various coupling sections can be arbitrarily combined with each other.

In addition, while various modified embodiments of the coupling sections have been described, these modified embodiments can be arbitrarily combined with each other. For example, as shown in FIG. 29, the coupling section $\mathbf{5}_1$ may have the configuration of the coupling section according to the application example shown in FIG. 26, the coupling section $\mathbf{5}_2$ may be configured according to the embodiment 10 (FIG. 13), and the coupling section $\mathbf{5}_3$ may be configured according to the embodiment 8 (FIG. 11). The embodiments described above can be arbitrarily combined with each other.

Figure 30:
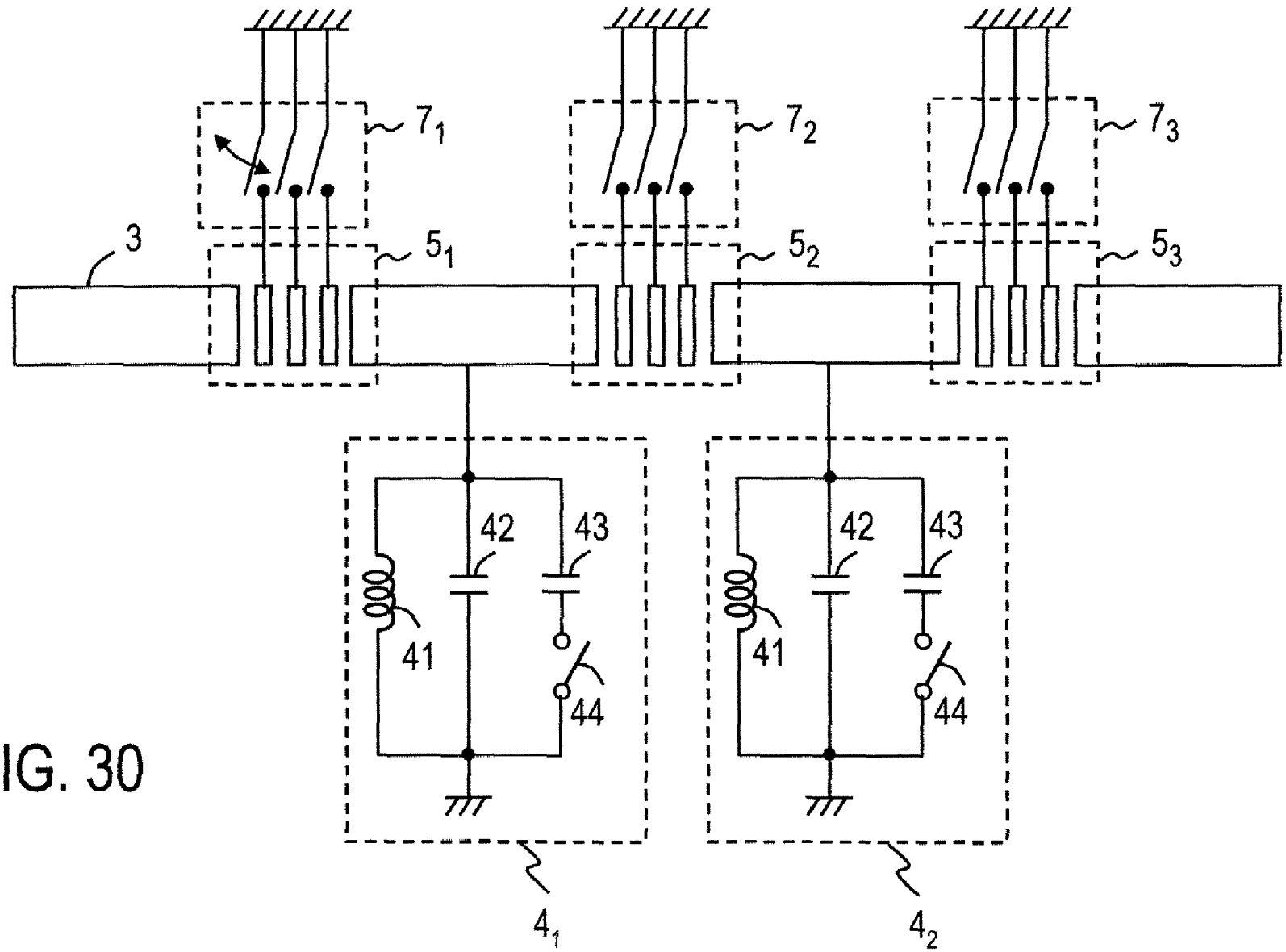
FIG. 30 shows a tunable filter according to the present invention in which the resonators are constituted by lumped constant elements.
Figure 31:
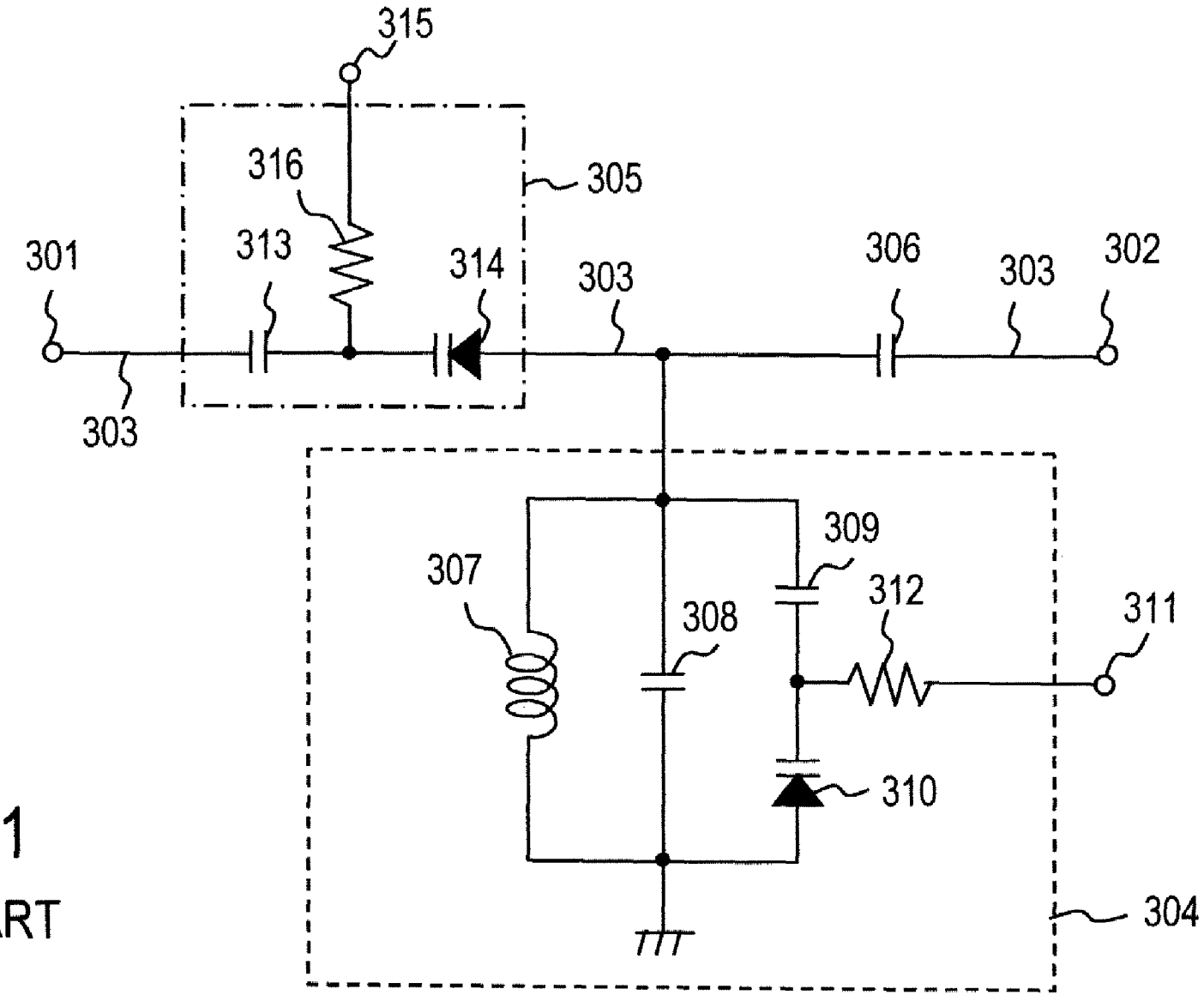
FIG. 31 PRIOR ART
FIG. 31 shows a filter capable of controlling and varying both the center frequency and the bandwidth disclosed in the Patent literature 1.

Furthermore, while the resonator constituted by a distributed constant circuit capable of varying the resonant line length has been described with regard to the above embodiments, the tunable filter according to the present invention may be composed of a resonator constituted by lumped constant elements as shown in FIG. 30. In FIG. 30, the tunable resonator $\mathbf{4}_1$ shown in FIG. 25 is replaced with a resonator comprising a resonant coil 41, a resonant capacitor 42 and a series circuit composed of a resonance frequency varying capacitor 43 and a switch element 44 serving as resonance frequency varying means connected in parallel with each other. The tunable resonator $\mathbf{4}_2$ has exactly the same configuration as the resonator $\mathbf{4}_1$. A tunable filter capable of controlling both the bandwidth and the center frequency can be provided by combining such a resonator composed of lumped constant elements and the coupling section described above. While FIG. 30 shows a plurality of switch elements in each coupling section and only one set of the resonance frequency varying capacitor 43 and the switch element 44 serving as the resonance frequency varying means, a plurality of sets of the resonance frequency varying capacitor 43 and the switch element 44 may be provided. Furthermore, a variable inductor may be used for varying the resonance frequency. Alternatively, a variable capacitor, such as a varactor diode, may be used. In that case, the bandwidth can be precisely controlled in the coupling section, although the frequency reproducibility is reduced slightly as described above. Furthermore, the tunable filter according to the present invention can be provided even when a resonator other than the resonators described above is used. Furthermore, of course, design parameters, such as the number of coupling electrodes and the size of the gap, described above with regard to each embodiment can be modified without departing from the scope of the present invention defined in the claims.

While any specific example of the switch element has not been referred to, a transistor (a bipolar transistor, an FET or the like) or a diode may be used as the switch element. Alternatively, a micro electromechanical system (MEMS) switch may be used. The MEMS switch has a mechanical structure and is suitable for direct connection between metals and electrodes having low resistance and connection via a capacitor, and therefore, the MEMS switch is unlikely to cause distortion of the signal waveform. For example, the MEMS switch shown in FIG. 20 of Japanese Patent Application Laid-Open No. 2005-25059, which has been previously filed by the applicant, can be used.

What is claimed is:

1. A tunable filter, comprising:

an input/output line formed on a dielectric substrate;

at least two coupling sections inserted in series in the input/output line at a distance from each other in the longitudinal direction of the input/output line, each of the coupling sections including a gap dividing the input/output line in a width direction thereof, and one or more coupling electrodes arranged in the gap in the longitudinal direction of the input/output line;

a resonator connected to the input/output line between every adjacent two of said coupling sections and configured to vary a resonance frequency thereof;

switch means for performing at least one of selective grounding of the coupling electrodes of the coupling sections and selective short-circuiting among the coupling electrodes or between the coupling electrodes and the input/output line to vary a frequency bandwidth of each coupling section; and resonance frequency varying means for varying the resonance frequency of the resonator in association with the switch means.

2. The tunable filter according to claim 1, wherein the length of at least one of the coupling electrodes of at least one of said coupling sections in the width direction of the input/output line is greater than the width of the input/output line.

3. The tunable filter according to claim 1, wherein at least one of said coupling sections has a plurality of the coupling electrodes, and at least two of said plurality of the coupling electrodes are arranged to partially face each other in the longitudinal direction of the input/output line.

4. The tunable filter according to claim 1, wherein opposed portions of adjacent ones of the coupling electrodes and/or opposed portions of the coupling electrode and an end of said input/output line in at least one of said coupling sections are comb-shaped so as to mesh with each other.

5. The tunable filter according to claim 1, 2 or 4, wherein each of the coupling electrode of at least one of said coupling sections is divided into two parts in the width direction of the input/output line, and said switch means is provided for each of the divided parts of the coupling electrodes.

6. The tunable filter according to claim 5, wherein the two divided parts of the coupling electrodes differ in size from each other.

7. The tunable filter according to any of claims 1 to 4, wherein at least one of said coupling sections has an offset coupling section formed within the gap and coupled to the input/output line and to a plurality of the coupling electrodes.

8. The tunable filter according to claim 7, wherein said offset coupling section has a first offset coupling section and a second offset coupling section which extend from one and the other of the opposed ends of the input/output line on the opposite sides of the gap toward the other and the one of the other opposed ends and which are displaced from each other in the width direction of the input/output line.

9. The tunable filter according to claim 8, wherein at least one offset coupling electrode is disposed between the tips of the first and second offset coupling sections at a distance from the first and second offset coupling sections.

10. The tunable filter according to claim 8, wherein the first and second offset coupling sections are adjacent to each other at a distance in the width direction of the input/output line.

11. The tunable filter according to claim 8, wherein the first and second offset coupling sections extend on the opposite sides of the coupling electrodes in the width direction of the input/output line at a distance from the coupling electrodes.

12. The tunable filter according to any one of claims 1 to 4, wherein the opposed ends of the input/output line in at least one of said coupling sections are widened by a predetermined length.

13. The tunable filter according to any of claims 1 to 4, wherein at least one of said coupling sections has a three-dimensional structure in which the coupling electrodes are thicker than the input/output line.

14. The tunable filter according to any of claims 1 to 4, wherein at least one of said coupling sections has an offset coupling section that is embedded in the dielectric substrate at a distance from the surface of the dielectric substrate on which the input/output line is formed and faces and is coupled to at least one of the coupling electrodes, and the offset coupling section is connected to the input/output line at one end via a connecting conductor.

15. The tunable filter according to any of claims 1 to 4, wherein at least one of said coupling sections has an offset coupling section that is disposed above the dielectric substrate at a distance from the surface of the dielectric substrate on which the input/output line is formed and faces and is coupled to at least one of the coupling electrodes, and the offset coupling section is connected to the input/output line at one end via a connecting conductor.

16. The tunable filter according to claim 14, wherein the coupling electrodes extend perpendicularly to the dielectric substrate, and the offset coupling section has coupling protrusions arranged alternately with the coupling electrodes extending perpendicularly.

17. The tunable filter according to claim 15, wherein the coupling electrodes of said at least one of the coupling sections extend perpendicularly to the dielectric substrate, and the offset coupling section has coupling protrusions that face and are coupled to the coupling electrodes extending perpendicularly.

18. A tunable filter, comprising: an input/output line formed on a dielectric substrate; at least two coupling sections inserted in series in the input/output line at a distance from each other in the longitudinal direction of the input/output line, each of the coupling sections including a gap dividing the input/output line in a width direction thereof, the divided input/output lines having wider parts opposing each other via the gap of at least one of said at least two coupling sections, at least one slit extending in the width direction of the input/output line being formed in the wider parts, and a coupling electrode extending in the longitudinal direction of the slit being disposed in each slit; a resonator connected to the input/output line between every adjacent two of the coupling sections and configured to vary a resonance frequency thereof; switch means for performing at least one of selective grounding of the coupling electrodes of the coupling sections and selective short-circuiting among the coupling electrodes or between the coupling electrodes and the input/output line to vary a fractional bandwidth of the tunable filter; resonance frequency varying means for varying the resonance frequency of the resonator in association with the switch means.

19. The tunable filter according to claim 18, wherein at least one coupling electrode is disposed in the gap between the wider parts of at least one of said coupling sections, and the tunable filter has another switch means for selectively grounding the coupling electrode or selectively short-circuiting the coupling electrode to the input/output line.

20. The tunable filter according to claim 1, 2, 3, 4 or 18, wherein the resonator is capable of varying the length of the resonant line and has wider parts arranged in the longitudinal direction of the resonant line, and the resonance frequency varying means is a switch provided on each of the opposite ends of the wider parts.

* * * * *